US006675714B2

(12) United States Patent
Furukawa

(10) Patent No.: US 6,675,714 B2
(45) Date of Patent: Jan. 13, 2004

(54) INK AND WATER SUPPLY CONTROLLER IN PRINTING MACHINE, PRINTING SYSTEM WITH SUCH CONTROLLER, AND PROGRAM THEREFOR

(75) Inventor: Itaru Furukawa, Kyoto (JP)

(73) Assignee: Dainippon Screen Mfg. Co., Ltd., Kyoto (JP)

( * ) Notice: Subject to any disclaimer, the term of this patent is extended or adjusted under 35 U.S.C. 154(b) by 0 days.

(21) Appl. No.: 10/201,051

(22) Filed: Jul. 24, 2002

(65) Prior Publication Data

US 2003/0019382 A1 Jan. 30, 2003

(30) Foreign Application Priority Data

Jul. 26, 2001 (JP) ..... P2001-226259

(51) Int. Cl.[7] ..... B41F 1/54

(52) U.S. Cl. ..... 101/484; 101/211; 101/365; 101/485; 101/450.1; 101/DIG. 45; 101/DIG. 47; 358/1.18; 382/173

(58) Field of Search ..... 101/484, 485, 101/211, 450.1, 365, DIG. 45, DIG. 47; 358/1.18, 1.6, 1.9; 382/173

(56) References Cited

U.S. PATENT DOCUMENTS 4,660,159 A * 4/1987 Ott ..... 101/365
4,967,379 A * 10/1990 Ott ..... 101/211
5,182,721 A * 1/1993 Kipphan et al. ..... 101/484
5,224,421 A * 7/1993 Doherty ..... 101/211
5,357,448 A * 10/1994 Stanford ..... 382/112
5,460,090 A * 10/1995 Pfeiffer et al. ..... 101/365
5,903,712 A * 5/1999 Wang et al. ..... 101/211
5,967,049 A * 10/1999 Seymour et al. ..... 101/485
5,967,050 A * 10/1999 Seymour ..... 101/484
6,441,914 B1 * 8/2002 Barak et al. ..... 358/1.14
6,539,863 B2 * 4/2003 Shiraishi ..... 101/365
2003/0110963 A1 * 6/2003 Martin et al. ..... 101/147

OTHER PUBLICATIONS

M. Nagao, "Methods of Image Pattern Recognition", Corona Publishing Co., Ltd., 1983, p. 94.

* cited by examiner

*Primary Examiner*—Eugene H. Eickholt
(74) *Attorney, Agent, or Firm*—McDermott, Will & Emery

(57) ABSTRACT

A printing machine provided allows even unskilled operators to perform ink and water supply control according to the contents of an image. While a reference image to be printed is segmented into a plurality of regions similar in contents, image data is obtained from printed matter and a color difference between the reference image and a print image is calculated. Ink and water (I/W) supplies are determined based on regional color difference data obtained by summing the color differences for each region. At this time, by adding correction of the regional color difference data based on the characteristics of each region and the contents of the image, and correction of the I/W supplies based on external factors and variables, even unskilled operators can perform rapid I/W supply control based on the contents of the image.

15 Claims, 27 Drawing Sheets

PSTD

FIG. 8A
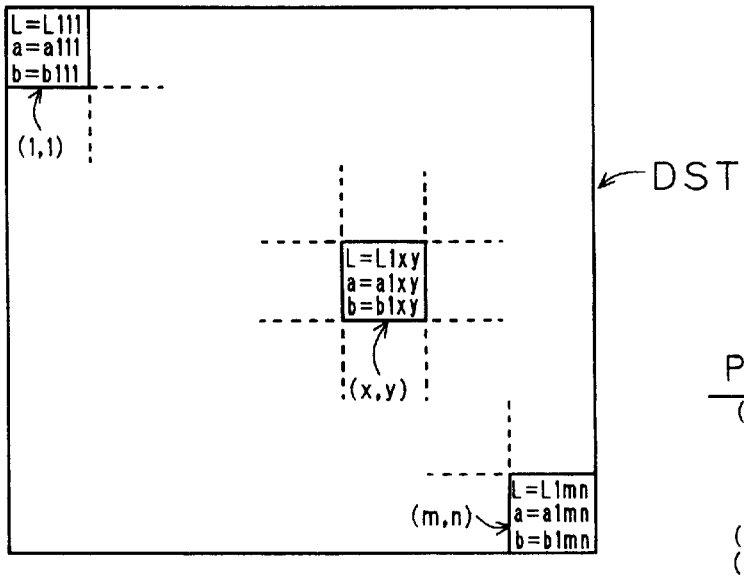
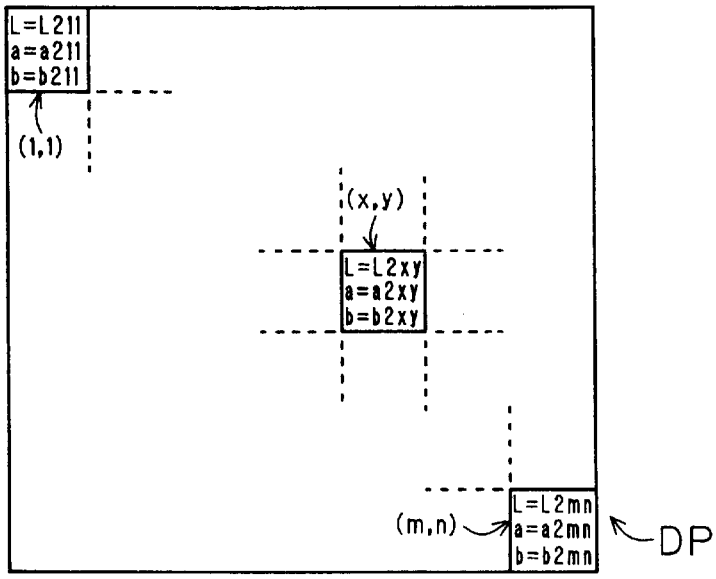
FIG. 8B
| PIXEL | COLOR DIFFERENCE |
|---|---|
| (1,1) | (ΔL11,Δa11,Δb11) |
| ⋮ | ⋮ |
| (1,n) | (ΔL1n,Δa1n,Δb1n) |
| (2,1) | (ΔL1n,Δa1n,Δb1n) |
| ⋮ | ⋮ |
| (x,y) | (ΔLxy,Δaxy,Δbxy) |
| ⋮ | ⋮ |
| (m,n) | (ΔLmn,Δamn,Δbmn) |

PST

PSTD

FIG. 16

PTB

| REGION NUMBER | CHROMATICITY | | | | | | TEXTURE | SIZE | LOCATION | | ADJACENT REGION NUMBER | REGIONAL COLOR DIFFERENCE | | | REGIONAL ATTRIBUTE |
|---|---|---|---|---|---|---|---|---|---|---|---|---|---|---|---|
| ID | BARYCENTER | | | HALF WIDTH | | | T | S | xi | yi | NID | ΔL | Δa | Δb | A |
| 1 | L1 | a1 | b1 | WL1 | Wa1 | Wb1 | T1 | S1 | x1 | y1 | K11, K12, ··· K1m | ΔL1 | Δa1 | Δb1 | A1 |
| · · · | · · · | · · · | · · · | · · · | · · · | · · · | · · · | · · · | · · · | · · · | · · · | · · · | · · · | · · · | · · · |
| i | Li | ai | bi | WLi | Wai | Wbi | Ti | Si | xi | yi | Ki1, ·· Kimi | ΔLi | Δai | Δbi | Ai |
| · · · · | · · · · | · · · · | · · · · | · · · · | · · · · | · · · · | · · · · | · · · · | · · · · | · · · · | · · · · | · · · · | · · · · | · · · · | · · · · |
| n | Ln | an | bn | WLn | Wan | Wbn | Tn | Sn | xn | yn | Kn1, ·· Knmn | ΔLn | Δan | Δbn | An |

ID

DAR

DCAR

DAAR

FIG. 18A

| | | |
|---|---|---|
| SMALL ← | Wi | → LARGE |
| HIGH ← | fWi | → LOW |

FIG. 18B

| | | |
|---|---|---|
| SMALL ← | Si | → LARGE |
| LOW ← | fSi | → HIGH |

FIG. 18C

| | | |
|---|---|---|
| COARSE ← | Ti | → FINE |
| LOW ← | fTi | → HIGH |

FIG. 18D

| | | |
|---|---|---|
| Naf ≠ | Ai | = Naf |
| 1 = | fAi | = fA0 |

FIG. 18E

| | | |
|---|---|---|
| SMALL ← | xi−x1<br>xm−xi<br>yi−y1<br>yn−yi | → LARGE |
| HIGH ← | fxyi | → LOW |

FIG. 18F

| | | |
|---|---|---|
| SMALL ← | yi−ybij+1 | → LARGE |
| LOW ← | fbi | → HIGH |

FIG. 18G

| | | |
|---|---|---|
| SMALL ← | 100−bKi | → LARGE |
| HIGH ← | fgbi | → LOW |

FIG. 19

| | COLOR DIFFERENCE CORRECTION FACTOR | REGION NUMBER |
|---|---|---|
| (a) | HIGH | 1 2 7 8 |
| | LOW | 9 10 12 13 |
| (b) | HIGH | 8 14 |
| | LOW | 16 |
| (c) | HIGH | 3 9 10 12 |
| | LOW | 4 8 |
| (d) | fA0 | 4 5 6 7 |
| | 1 | ANY NUMBER OTHER THAN ABOVE |
| (e) | HIGH | 15 17 |
| | LOW | 11 12 |
| (f) | HIGH | 3 4 8 9 11 14 |
| | LOW | 13 17 |
| (g) | HIGH | 18 |

FIG. 20

| SUPPLY TO BE CONTROLLED | ITEM | SUBJECTIVE INFORMATION | SUBJECTIVE INFORMATION FACTOR |
|---|---|---|---|
| INK | i1 | ABNORMAL MECHANICAL SOUND | si1 |
| | i2 | VISCOSITY LOWER THAN THE PRESCRIBED VALUE | 1 |
| | . | . | . |
| | . | . | . |
| | . | . | . |
| | iN | . | SiN |
| WATER | w1 | SUNNY CLIMATE FROM MORNING | sw1 |
| | . | . | . |
| | . | . | . |
| | wM | . | SwM |

INK AND WATER SUPPLY CONTROLLER IN PRINTING MACHINE, PRINTING SYSTEM WITH SUCH CONTROLLER, AND PROGRAM THEREFOR

BACKGROUND OF THE INVENTION

1. Field of the Invention

The present invention relates to a general purpose commercial printing machine or system for continuously producing huge volumes of printed matter.

2. Description of the Background Art

In general purpose commercial printing for production of printed matter such as newspaper, magazines, books and advertisements, huge volumes of printed matter are produced continuously from the same plate. To keep the quality of printed matter in such mass and continuous printing, it is necessary to produce proper and stable supplies of consumable ink and water used in a printing machine. This is because an excess or short ink supply causes a color irregularity in printed matter and an excess or short water supply causes skipping and blurring in printed matter; that is, an excess or short supply results in poor printed matter.

In a printing process, ink and water supply control has conventionally been performed based on a skilled printing-machine operator's experience and intuition. The operator called a "chief operator" determines and controls ink and water supplies as appropriate based on the characteristics of printing elements (characters or illustrations) such as color, shape, size and location, various conditions such as the surrounding environment of each printing machine (e.g., temperature and humidity) and ink viscosity, and past case examples of printing.

For ink supply control, the following automatic supply control methods such as color patch measurement and image comparison have also been used formerly.

(1) Color Patch Measurement Method

FIG. 22 is a diagram showing an example of color patches for use in this method. In FIG. 22, printing paper PP1 shall move in a print direction D1 indicated by the arrow for printing. On a margin region MG11 belonging to an ink supply region $I_{S11}$ of the printing paper PP1, color patches PC, PM, PY and PK corresponding respectively to cyan (C), magenta (M), yellow (Y) and black (K) are printed. The color patch PC for cyan consists of four color patches PC1 to PC4 of different densities. The same can be said of the color patches PM, PY and PK. Although not shown, in ink supply regions $I_{S12}$ and $I_{S13}$ adjacent to the ink supply region $I_{S11}$, color patches PC, PM, PY and PK are also printed similarly on their respective margin regions MG12 and MG13.

In the color patch measurement method, the densities of the color patches PC, PM, PY and PK are measured and compared with originally intended densities (reference chromaticity) after printing, and then differences in density (relative chromaticity) are fed back for ink supply control.

(2) Image Comparison Method

FIGS. 23A and 23B are diagrams for explaining the image comparison method. FIG. 23A shows part of image data DP1 contained within an ink supply region $I_{S20}$. The image data DP1 is generated by photographing printed matter on printing paper PP2 at low resolution or scanning it with a scanner. C1 to C9 represent pixels in the image data DP1. FIG. 23B shows image data DST0 corresponding to the data shown in FIG. 23A, in a reference image PST0 to be printed.

Pixels C1S to C9S correspond respectively to the pixels C1 to C9 in FIG. 23A. In both FIGS. 23A and 23B, the density of each pixel is expressed as the spacing between slant lines, where a narrower spacing represents a higher density.

In the image comparison method, relative chromaticity of corresponding pixels is calculated and the sum total of relative chromaticity for each supply region is fed back for ink supply control.

However, the conventional ink and water supply control methods have the following problems (hereinafter the ink supply is referred to as "I supply" and the water supply as "W supply" and both are generically referred to as "I/W supply").

First, I/W supply control by the "chief operator" is only possible for an operator who has accumulated enough experience to acquire technical skills; that is, it is impossible for an inexperienced operator. This entails high labor costs involving the cost of training. Besides, it cannot always be said that optimal I/W supply control can be achieved, because different operators may form different judgments or a judgment made by an operator may not always be the best.

Secondly, in the automatic supply control methods such as color patch measurement and image comparison, only the sum total of relative chromaticity for each pixel is obtained and no consideration is given to the contents of an image such as image data size, color, texture, and importance of the contents (e.g., in the case of a portrait, either a subject or a background). Also in the color patch measurement method, the relative chromaticity is judged from the color patches as representatives, and therefore, it may not be possible to fully address a local color irregularity, skipping and the like in printed matter.

SUMMARY OF THE INVENTION

The present invention is directed to an ink or water supply controller in a general purpose commercial printing machine for continuously producing huge volumes of printed matter.

According to the present invention, the controller comprises the following: (a) an object region setting element for setting a plurality of object regions in a reference image to be printed, the object regions being set based on reference image data representing the reference image; (b) a read element for reading an image of printed matter corresponding to the reference image to obtain print image data; (c) a comparison element for comparing the reference image data and the print image data for each of the object regions to obtain an image comparison result; and (d) a control variable calculation element for calculating control variables for ink and water in the printing machine, the control variables being calculated based on both a regional characteristic and the image comparison result obtained for each of the object regions.

According to a preferred embodiment of the present invention, objective ink and water supply control can be achieved based on a difference between reference image data for printing and image data obtained from actual printed matter, for each of the object regions.

According to an aspect of the present invention, the regional characteristic includes, as a visual image characteristic of each of the object regions, at least one of the following: (1) a color characteristic of each of the object regions; (2) a texture characteristic of each of the object regions; and (3) a regional attribute depending on the type of a print image included in each of the object regions.

This permits supply control reflecting a visual characteristic of each of the object regions.

According to another aspect of the present invention, the regional characteristic includes, as a geometrical characteristic of each of the object regions in the reference image, at least one of the following: (1) a region size of each of the object region; (2) a location of each of the object regions in the reference image; (3) relative positions of each of the object regions and an ink key region of the printing machine; and (4) relative positions of each of the object regions and its adjacent regions.

This permits supply control reflecting a geometrical characteristic of each of the object regions.

An object of the present invention is, therefore, to provide a printing machine control technique that can set ink and water supplies more properly according to the contents of an image to be printed.

These and other objects, features, aspects and advantages of the present invention will become more apparent from the following detailed description of the present invention when taken in conjunction with the accompanying drawings.

BRIEF DESCRIPTION OF THE DRAWINGS

FIGS. 8A and 8B are diagrams for explaining the calculation of color difference data for each pixel;

FIG. 16 is a diagram for explaining a regional parameter table PTB;

FIGS. 18A to 18G are diagrams for explaining a color difference correction factor;

FIG. 19 is a diagram showing the result of color difference correction to the example of region segmentation PSTD;

FIG. 20 is a diagram showing a subjective information factor database;

DESCRIPTION OF THE PREFERRED EMBODIMENTS

1. General Features of Printing System

Figure 1:
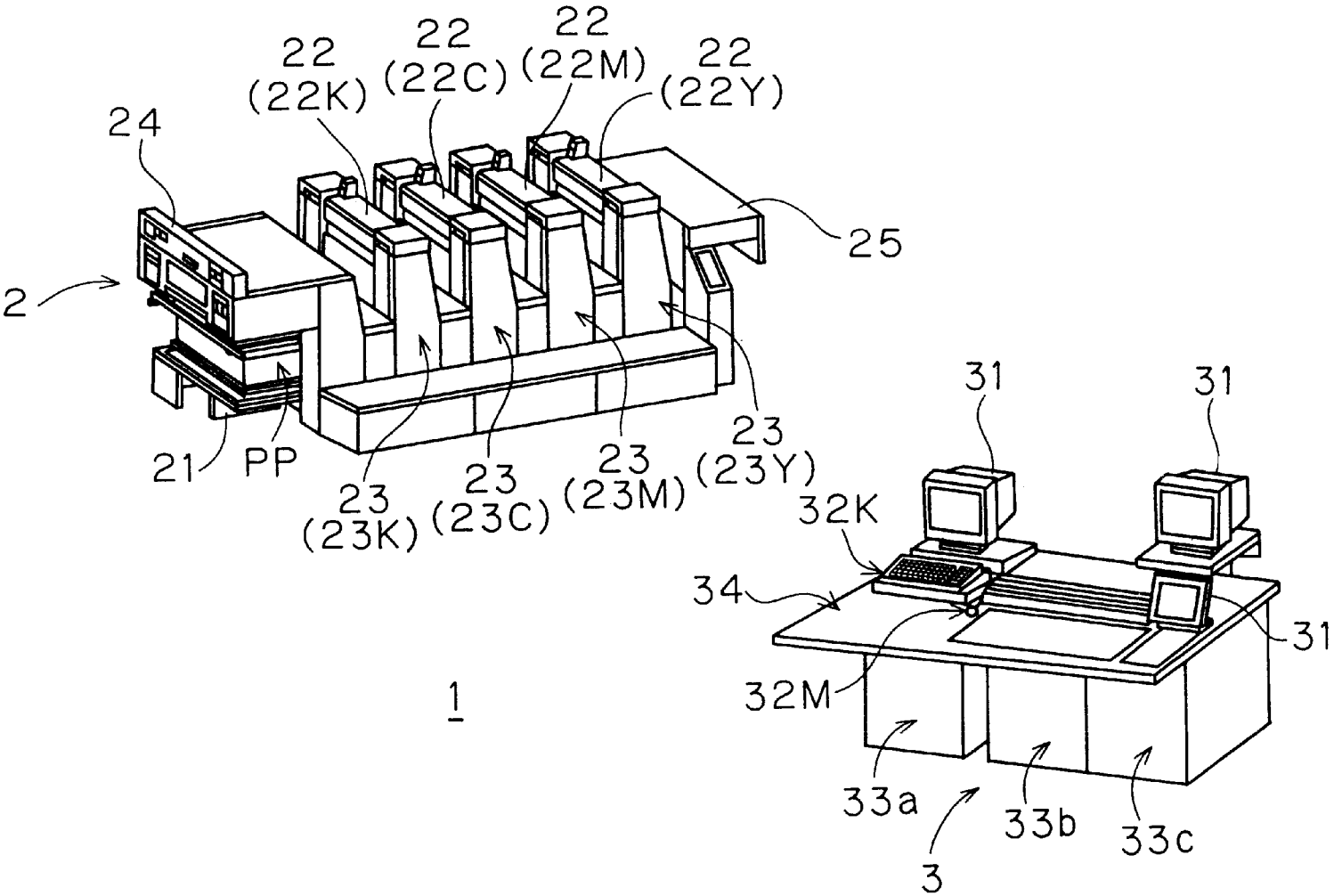
FIG. 1 is a diagram showing the general features of a printing system 1 according to a preferred embodiment of the present invention.
Figure 2:
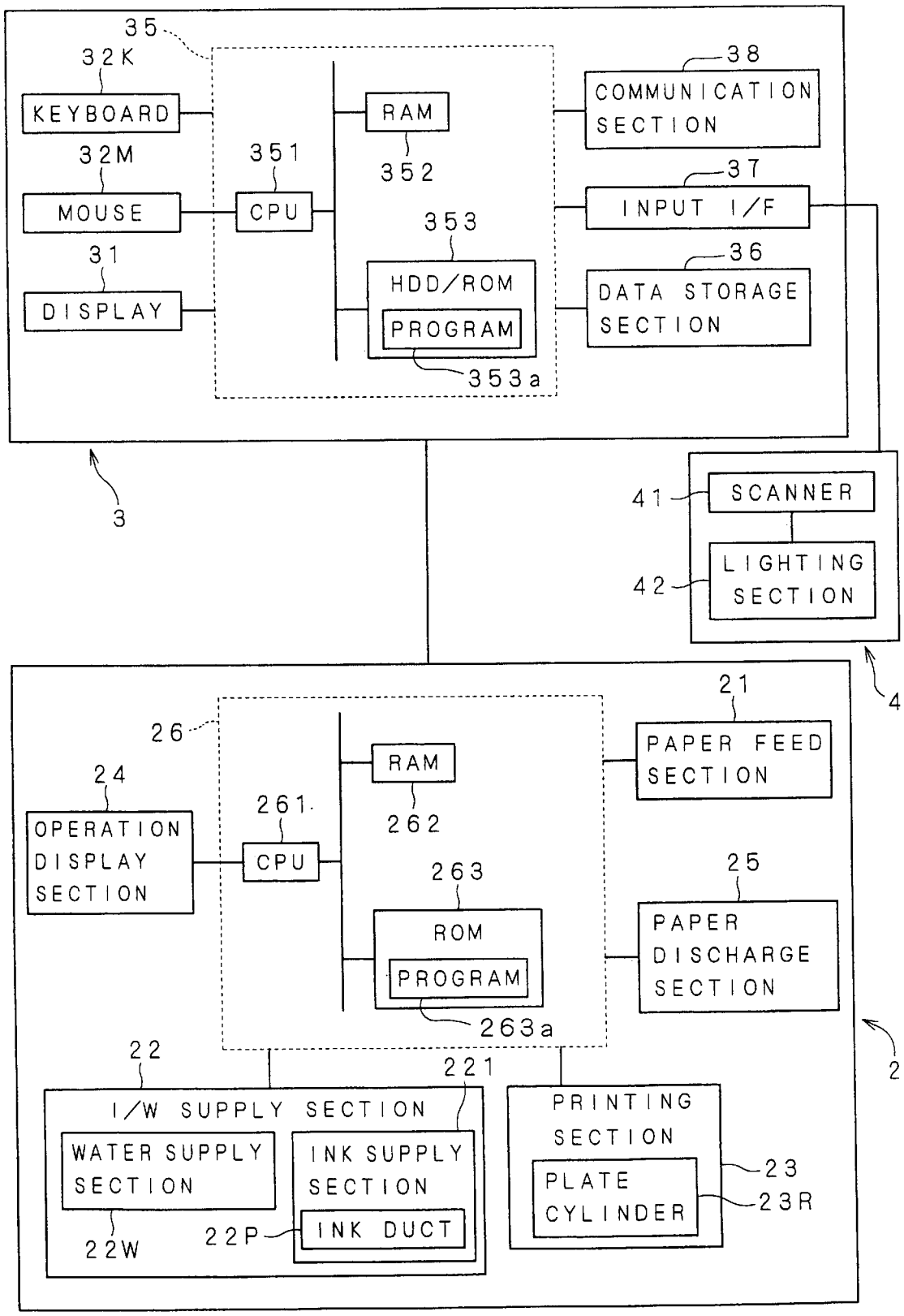
FIG. 2 is a block diagram of a hardware configuration of the printing system 1.

FIG. 1 is a diagram showing the general features of a printing system 1 including ink and water supply controllers according to a preferred embodiment of the present invention. FIG. 2 is a diagram showing the essential parts of a device configuration of a printing system 1. The printing system 1 comprises a printing machine 2, an image analysis processor 3, and an image input section 4 (FIG. 2) not shown in FIG. 1.

The printing machine 2, the image analysis processor 3 and the image input section 4 are connected to one another by a cable, so that they can receive and transmit commands and data from and to one another.

The printing machine 2 is a sheet-fed printing machine for printing one sheet of printing paper PP at a time. It comprises a paper feed section 21 for feeding the printing paper PP to the printing machine 2, an I/W supply section 22 for supplying ink and water, a printing section 23 for doing printing with a plate cylinder 23R, an operation display section 24 for displaying a printing state and making various settings, a paper discharge section 25 for discharging printed paper, and a control operation section 26.

The I/W supply section 22 comprises an ink supply section 22I for supplying ink from an ink duct 22P and a water supply section 22W for supplying water. In this preferred embodiment, the printing machine 2 comprises four supply sections 22C, 22M, 22Y and 22K for four-color printing with cyan (C), magenta (M), yellow (Y) and black (K). Correspondingly, the printing section 23 comprises four printing sections 23C, 23M, 23Y and 23K.

Figure 3:
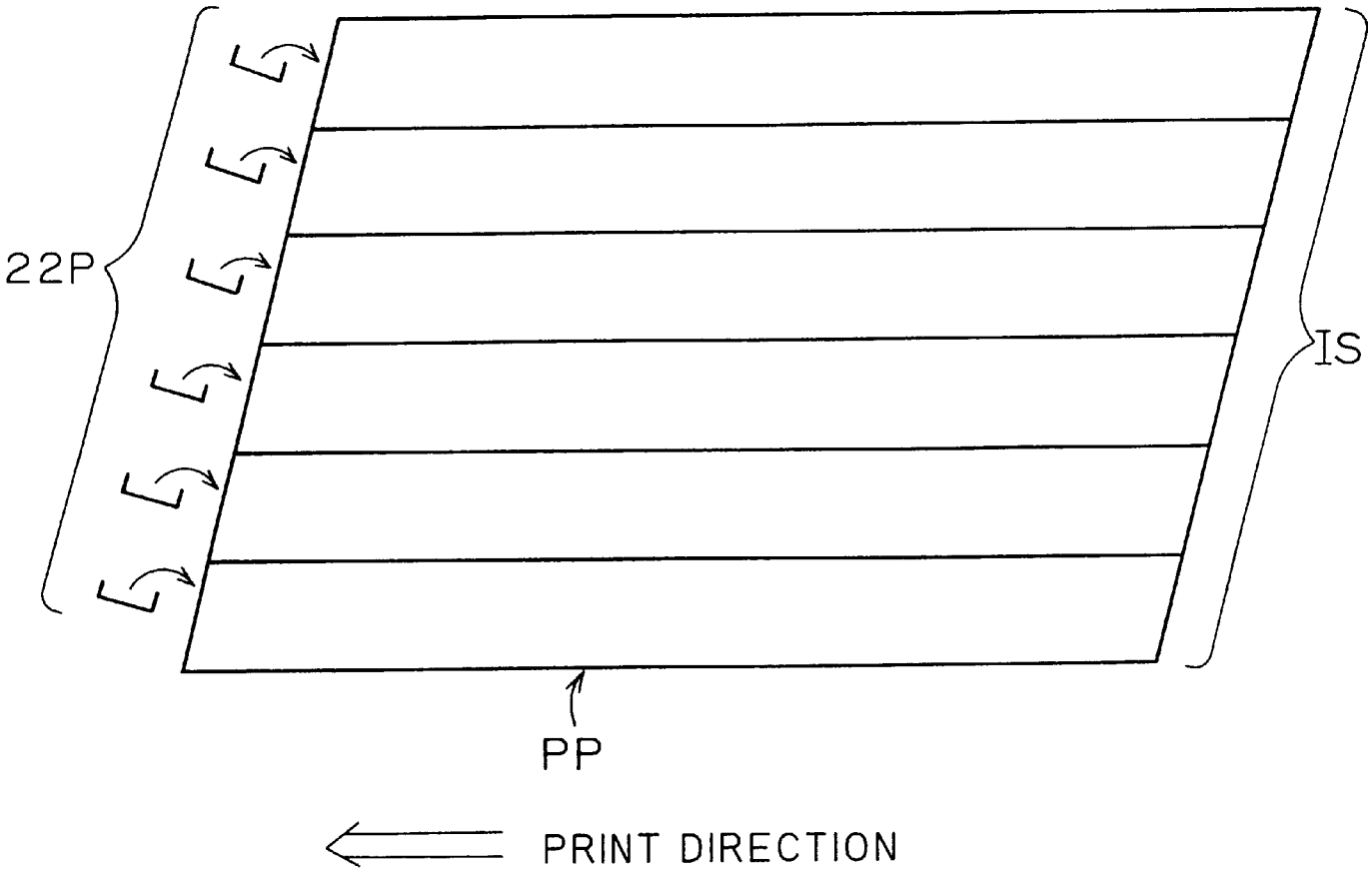
FIG. 3 is a diagram for explaining the relationship among ink ducts 22P, ink supply regions IS and a print direction D.

FIG. 3 is a schematic diagram showing the relationship between ink ducts and ink supply regions (ink key regions). A plurality of ink ducts 22P are arranged vertical to a print direction D. In the printing paper PP, a range where each of the ink ducts 22P provides ink supply is referred to as an ink supply region IS. That is, the printing paper PP is virtually divided into a plurality of ink supply regions IS parallel to the print direction D, and each of the ink supply regions IS is primarily printed with ink supplied from one of the ink ducts 22P.

The control operation section 26 comprises a CPU 261, a RAM 262, and a ROM 263 storing a program 263*a* for performing various kinds of operations of the printing machine 2.

The image analysis processor 3 has displays 31, a keyboard 32K and a mouse 32M placed on a console 34. Cabinets 33*a* to 33*c* under the console 34 comprises a control operation section 35, a data storage section 36 for storing various kinds of data to later be described, an input interface (I/F) 37 for fetching data from the image input section 4, and a communication section 38 having the function of communicating with other computers and the like.

The control operation section 35 comprises a CPU 351, a RAM 352, and a hard disk and ROM 353 for storing a program 353*a* for performing various kinds of operations of the image analysis processor 3 and the image input section 4. The configuration may be such that the program 353*a* in the image analysis processor 3 and the program 263*a* in the printing machine 2 are executed in synchronization with each other or that the program 263*a* may serve as a subprogram of the program 353*a*.

The image input section 4 comprises a scanner 41 and a lighting section 42. The scanner 41 optically reads an image and transmits it as digital data through the input I/F 37 to the image analysis processor 3. The lighting section 42 is a light source for image reading by the scanner 41. In image reading, CCD elements of the scanner 41 and spectral distribution characteristics of the lighting section 42 are adjusted so as to reproduce original colors of an image with high fidelity.

Figure 4:
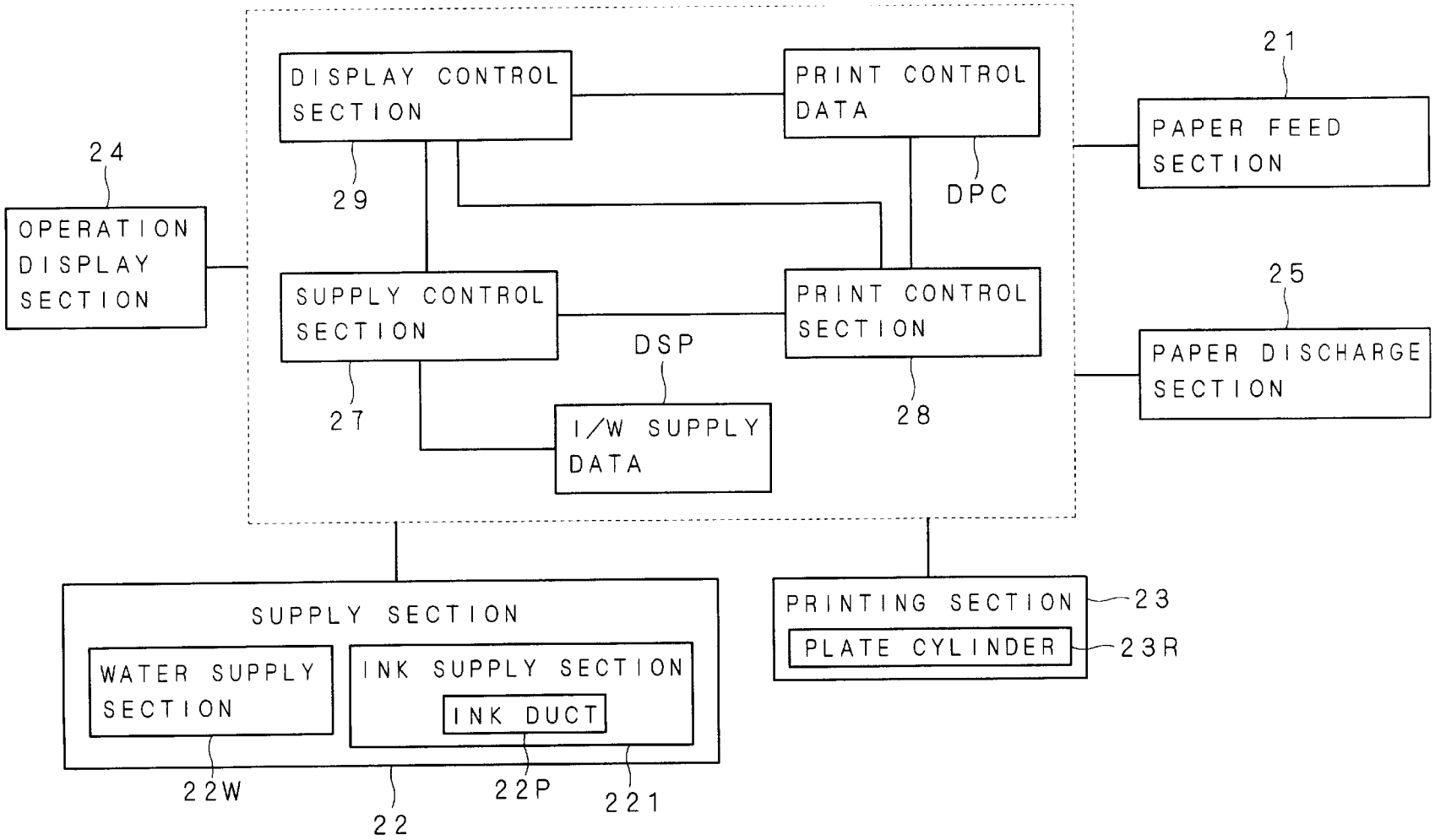
FIG. 4 is a data flow diagram of a printing machine 2.

FIG. 4 is a data flow diagram of the printing machine 2. The paper feed section 21, the I/W supply section 22, the printing section 23, the operation display section 24 and the paper discharge section 25 shown in FIG. 4 are all electrically coupled to the CPU 261. An I/W supply control section 27, a print control section 28 and a display control section 29 all are functions implemented by the CPU 261, the RAM 262, the ROM 263 and the like in FIG. 2. The supply control section 27 controls ink and water supplies from the ink supply section 22I and the water supply section 22W in the I/W supply section 22 according to I/W supply data DSP determined by the image analysis processor 3. The print control section 28, in conjunction with the supply control section 27, controls the operations of the printing section 23, the paper feed section 21 and the paper discharge section 25 based on print control data DPC entered by the user from the operation display section 24 or the image analysis processor 3. The display control section 29 displays an operating status of the printing machine 2 and the contents of a user's input command.

Figure 5A:
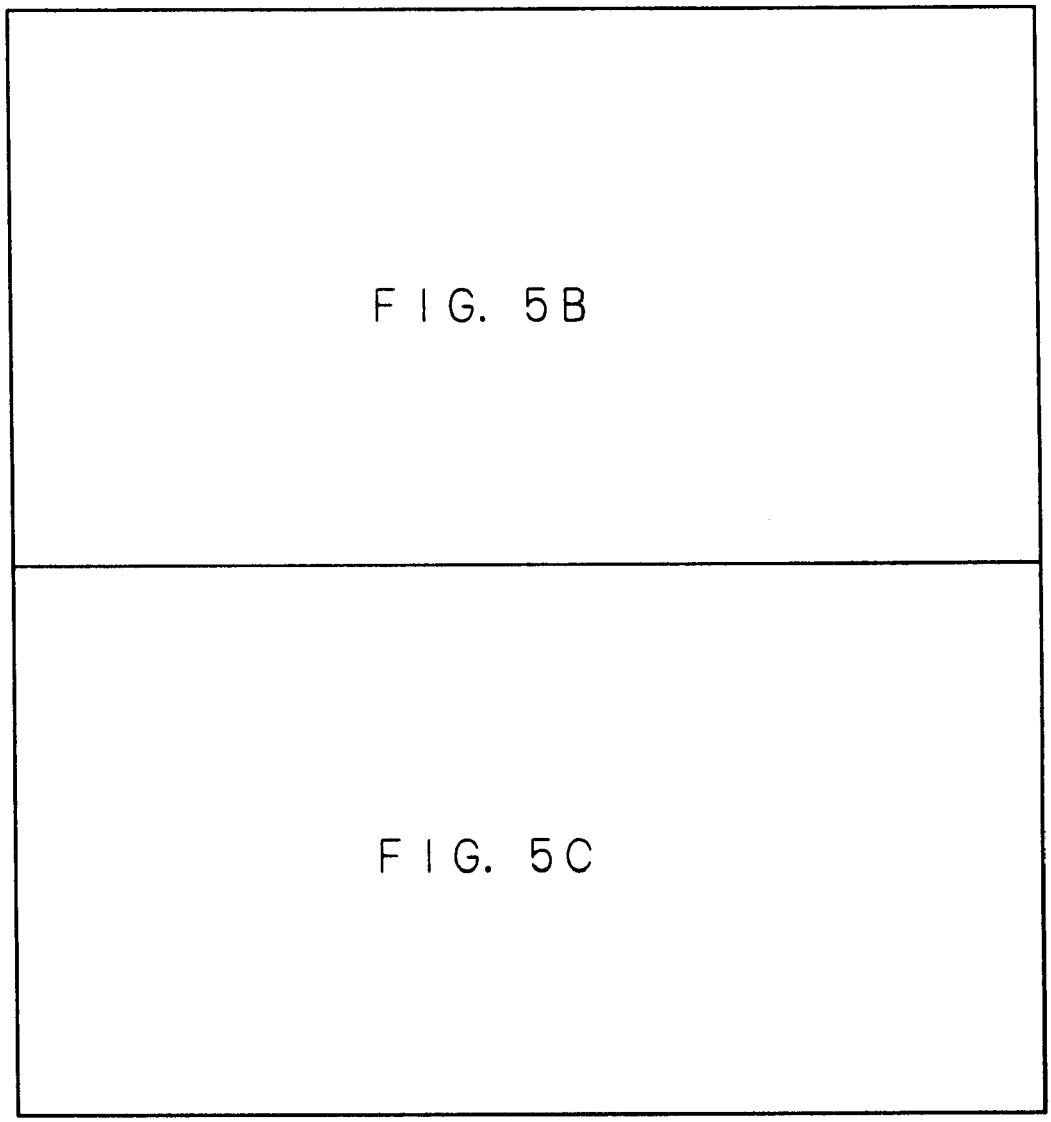
FIGS. 5A to 5C are data flow diagrams of an image analysis processor 3.
Figure 5B:
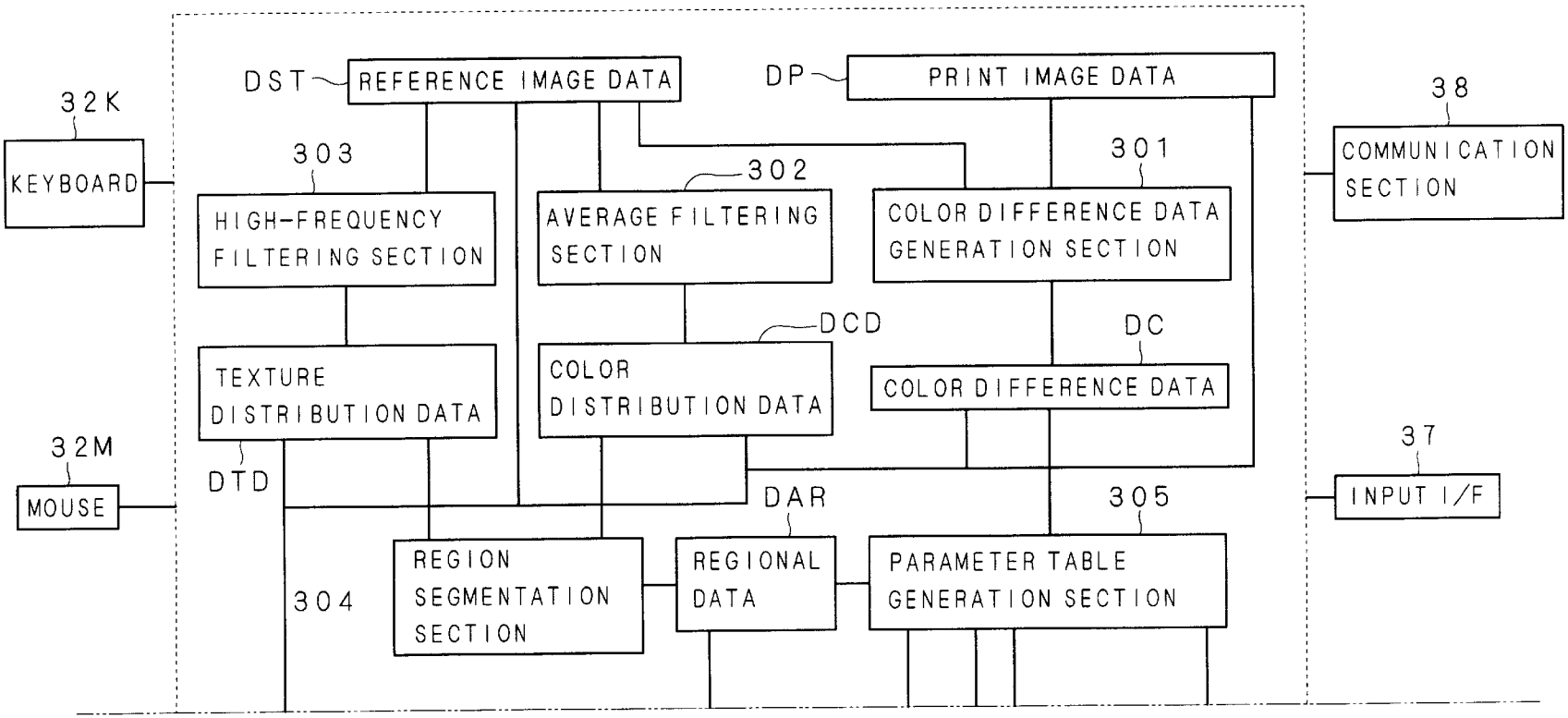
Figure 5C:
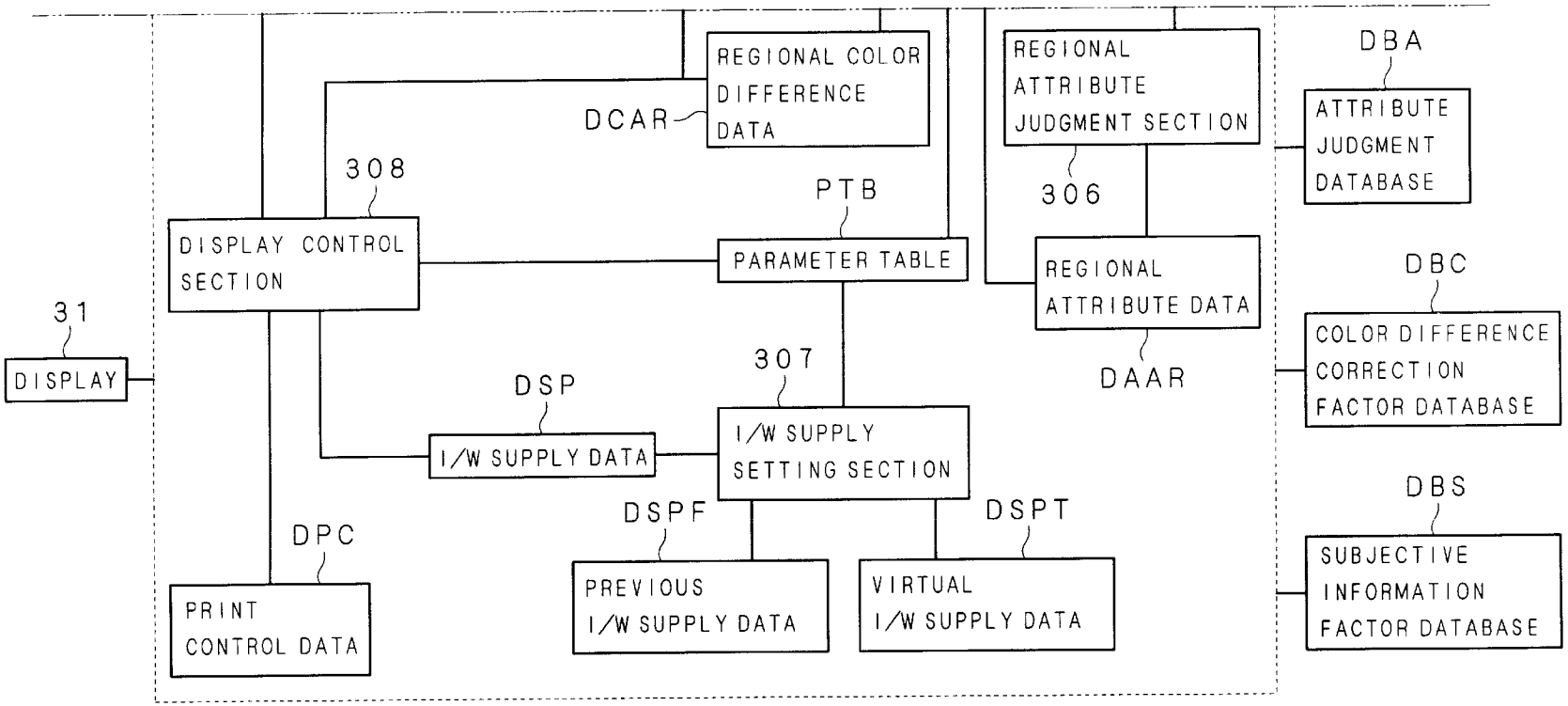

FIGS. 5A to 5C are data flow diagrams of the image analysis processor 3. The displays 31, the keyboard 32K, the mouse 32M, the input I/F 37 with the image input section 4, and the communication section 38 shown in FIGS. 5A to 5C are electrically coupled to the CPU 351. An attribute judgment database DBA, a color difference correction factor database DBC and a subjective information factor database DBS are stored in the data storage section 36 shown in FIG. 2.

A color difference data generation section 301, an average filtering section 302, a high-frequency filtering section 303, a region segmentation section 304, a parameter table generation section 305, a regional-attribute judgment section 306, an I/W supply setting section 307 and a display control section 308 are functions implemented via software by the CPU 351, the RAM 352, the hard disk and ROM 353, and the like. The general features thereof are described hereinbelow.

The color difference data generation section 301 calculates, for each pixel, a difference in chromaticity between reference image data DST and print image data DP, thereby to obtain color difference data DC for each pixel. The reference image data DST is digital data on a reference image PST consisting of characters and images to be printed, and the print image data DP is obtained from the image input section 4.

In this preferred embodiment, chromaticity is expressed in the L*a*b* calorimetric system, where chromaticity with the values of $L^*=\alpha$, $\alpha^*=\beta$ and $b^*=\gamma$ is expressed as $(\alpha, \beta, \gamma)$. Further, relative chromaticity of two chromaticity, $(\alpha 1, \beta 1, \gamma 1)$ and $(\alpha 2, \beta 2, \gamma 2)$ , i.e., a value of difference of each component $(\alpha 2-\alpha 1, \beta 2-\beta 1, \gamma 2-\gamma 1)$ is referred to as a "color difference".

The average filtering section 302 performs average filtering on the reference image data DST to produce color distribution data DCD representing a color distribution in the reference image PST. Average filtering is the process of averaging the chromaticity of adjacent pixels in the reference image data DST.

The high-frequency filtering section 303 performs high frequency filtering on the reference image data DST to produce texture distribution data DTD representing a texture distribution in the reference image PST. High frequency filtering is the process which is implemented by a so-called high-pass filter and which can extract only a two-dimensional pattern distribution independent of color from the reference image PST.

The region segmentation section 304 segments a reference image (e.g., FIG. 13) into a plurality of object regions AR (e.g., FIG. 15) based on either or both of the color distribution data DCD and the texture distribution data DTD, thereby to produce regional data DAR representing the characteristics of the image in each of the object regions AR. When the object regions AR are determined based on the color distribution data DCD, the reference image PST is segmented across boundaries defined according to aggregated color distributions, while when the object regions AR are determined based on the texture distribution data DTD, the reference image PST is segmented across boundaries defined according to spatial frequency distributions of texture. When using both the color distribution data DCD and the texture distribution data DTD, the object regions AR are determined by combining information on segment regions obtained from both the data. The determined object regions AR each are assigned a region number ID. The regional data DAR is obtained by converting evaluation values of predetermined evaluation elements of each object region AR into numbers. The evaluation elements for each of the object regions AR obtained from the reference image PST include, for example, the location and size of the region, a color distribution in the region, texture of the region, ink supply regions, and relative position of the region and its adjacent object regions AR.

The parameter table generation section 305, based on the regional data DAR and the color difference data DC, produces regional color difference data DCAR for each of the object regions AR by summing color differences for all pixels in the object region AR. This data DCAR is equivalent to the sum total of color differences for the object region AR. The parameter table generation section 305 further produces a regional parameter table PTB including the regional color difference data DCAR, the regional data DAR, and regional attribute data DAAR later to be described.

The regional-attribute judgment section 306 checks the regional data DAR for each of the object regions AR against attribute criteria stored in the attribute judgment database DBA and determines whether or not the object region AR has a specific attribute, thereby to produce the regional attribute data DAAR.

The I/W supply setting section 307, based on the regional color difference data DCAR, produces the I/W supply data DSP which is equivalent to I/W supply set values given to the printing machine 2. The I/W supply setting section 307 also carries out a correction of the regional color difference data DCAR using a color difference correction factor stored in the color difference correction factor database DBC and a subjective information factor which is stored in the subjective information factor database DBS and set based on the operator's empirical know-how.

The I/W supply data DSP is data that can be adjusted as appropriate according to the printing state. The process of determining the I/W supply data DSP in consideration of changes in ink supply with respect to time is also performed as a function of the I/W supply setting section 307. At this time, the I/W supply data DSP obtained as above described is once defined as virtual I/W supply data DSPT and then, final I/W supply data DSP is determined according to the amount of difference between the virtual I/W supply data DSPT and previous I/W supply data DSPF.

The display control section 308 controls display of the aforementioned various kinds of data and the print control data DPC which is data regarding control of the printing machine 2, on the displays 31 and the operation display section 24 in the printing machine 2.

2. Supply Setting Process

Figure 6A:
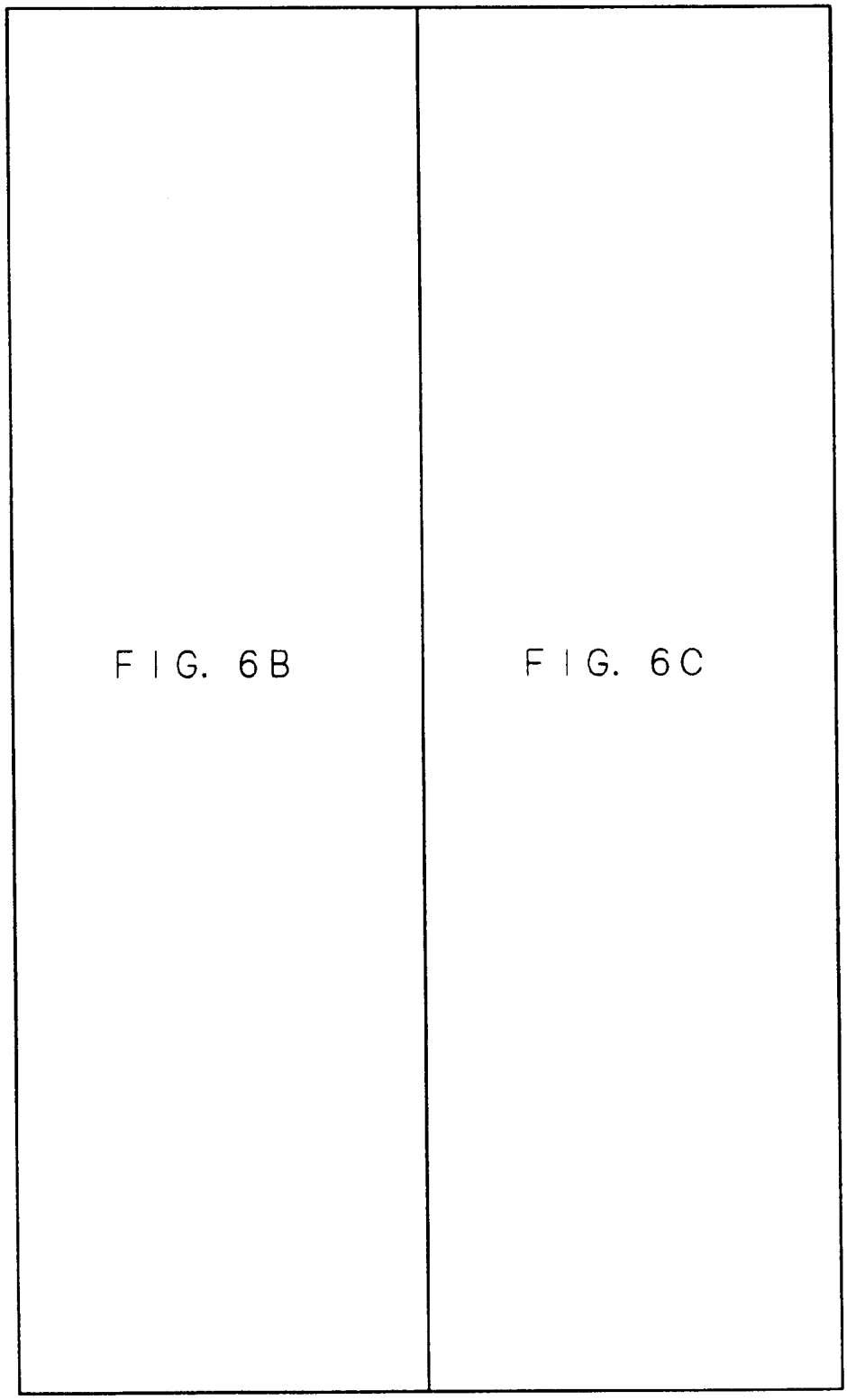
FIGS. 6A to 6C are process flow charts of I/W supply control according to the preferred embodiment of the present invention.
Figure 6B:
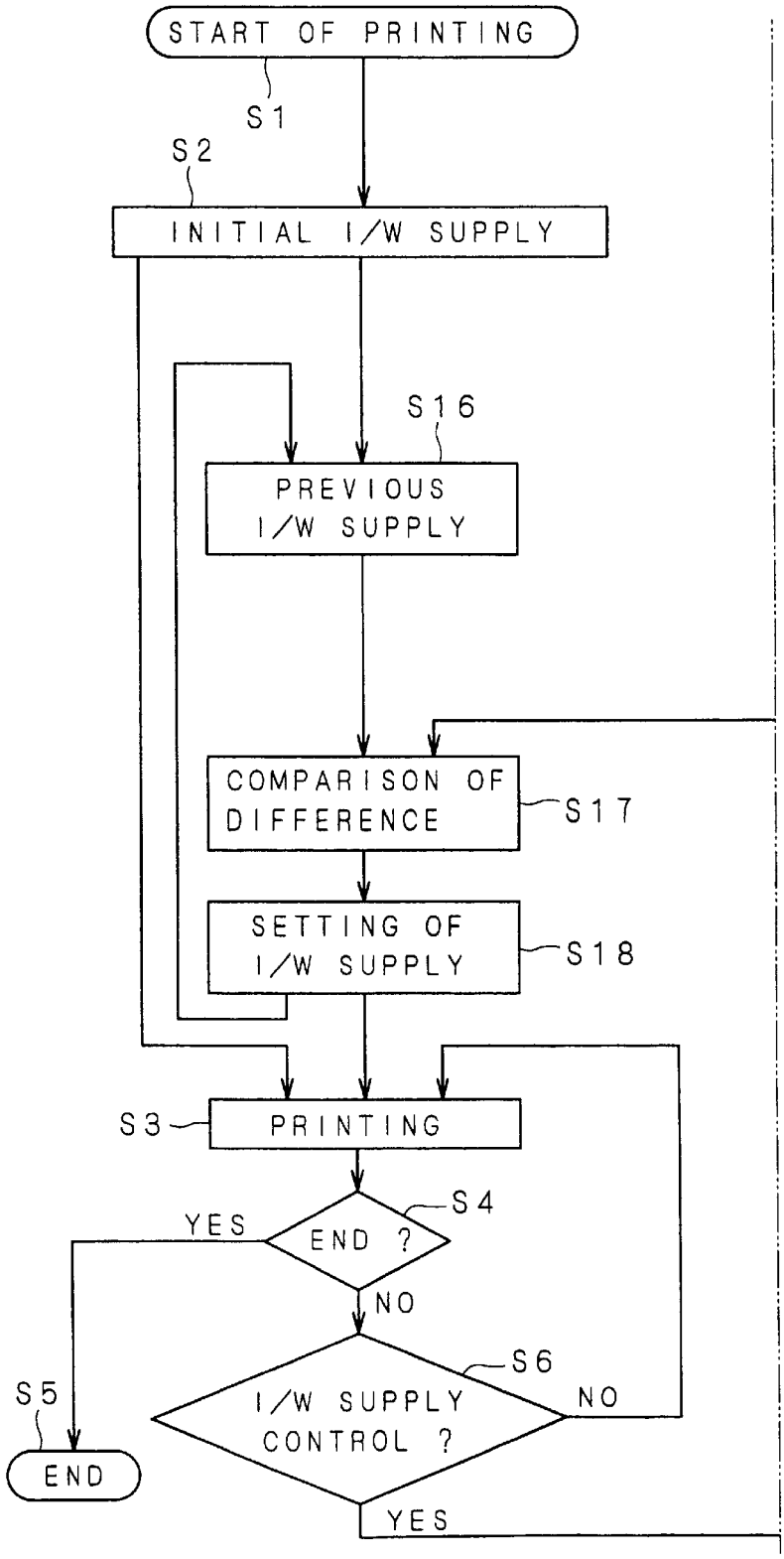
Figure 6C:
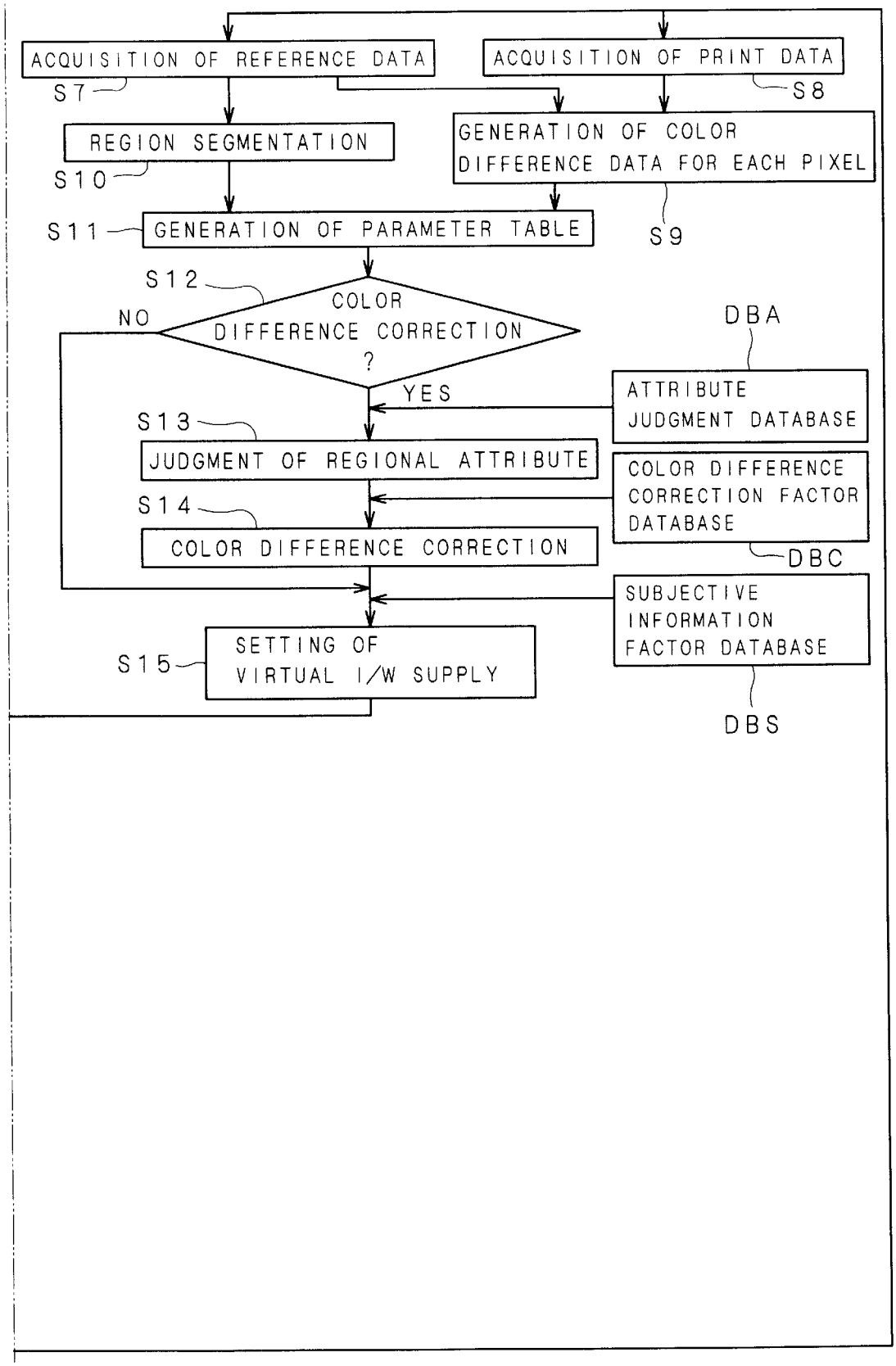

FIGS. 6A to 6C are flow charts showing the process of setting ink and water supplies. Hereinbelow, processing in each step shown in FIGS. 6A to 6C will be described in detail.

2-1. Initial State

Printing starts simultaneously with the feed of the printing paper PP (step S1). An I/W supply Q at the start of printing is defined as an initial I/W supply Q0 (step S2). Upon the feed of the printing paper PP to the printing section 23, printing is performed (step S3). At this point, if produced printed matter is of satisfactory quality, printing is carried on without changing the initial I/W supply Q0 or completed if a required number of sheets have already been printed. In commercial printing for producing huge number of printed sheets, however, it is extremely unlikely that printed matter of satisfactory quality can be produced without controlling the I/W supply Q, and therefore, printed matter in the initial state is usually poor printed matter called "waste sheets". To produce printed matter of good quality, control of the I/W supply Q is to be performed (steps S4, S5, S6).

2-2. Image Data Acquisition

For I/W supply control, the reference image data DST and the print image data DP are obtained (steps S7, S8). The reference image data DST, in most cases, is digital data produced by a DTP software or system and is to be a source for plate production. The print image data DP is digital data obtained by optically reading produced printed matter with the scanner 41.

2-3. Resolution Setting

To produce the color difference data DC, a color difference between the reference image data DST and the print image data DP should be obtained for each corresponding ones of pixels, for which the resolutions and sizes of the reference image data DST and the print image data DP must be in agreement with each other. However, it is not always necessary to employ the resolution of the reference image data DST in processing for obtaining the print image data DP. The processing may be performed by reducing the resolution to such an extent that the printing condition of printed matter can be grasped. In that case, the resolution of the reference image data DST is reduced to the level of the obtained print image data DP for obtaining a color difference for each pixel. Since chromaticity of adjacent pixels is not so different excluding exceptional parts such as areas of extremely fine texture and areas with a sudden color change, general information about chromaticity can be acquired even with reduced pixel resolution. Reduced resolution also brings about the advantage of smooth processing, since it can result in a reduction in data size.

Figure 7:
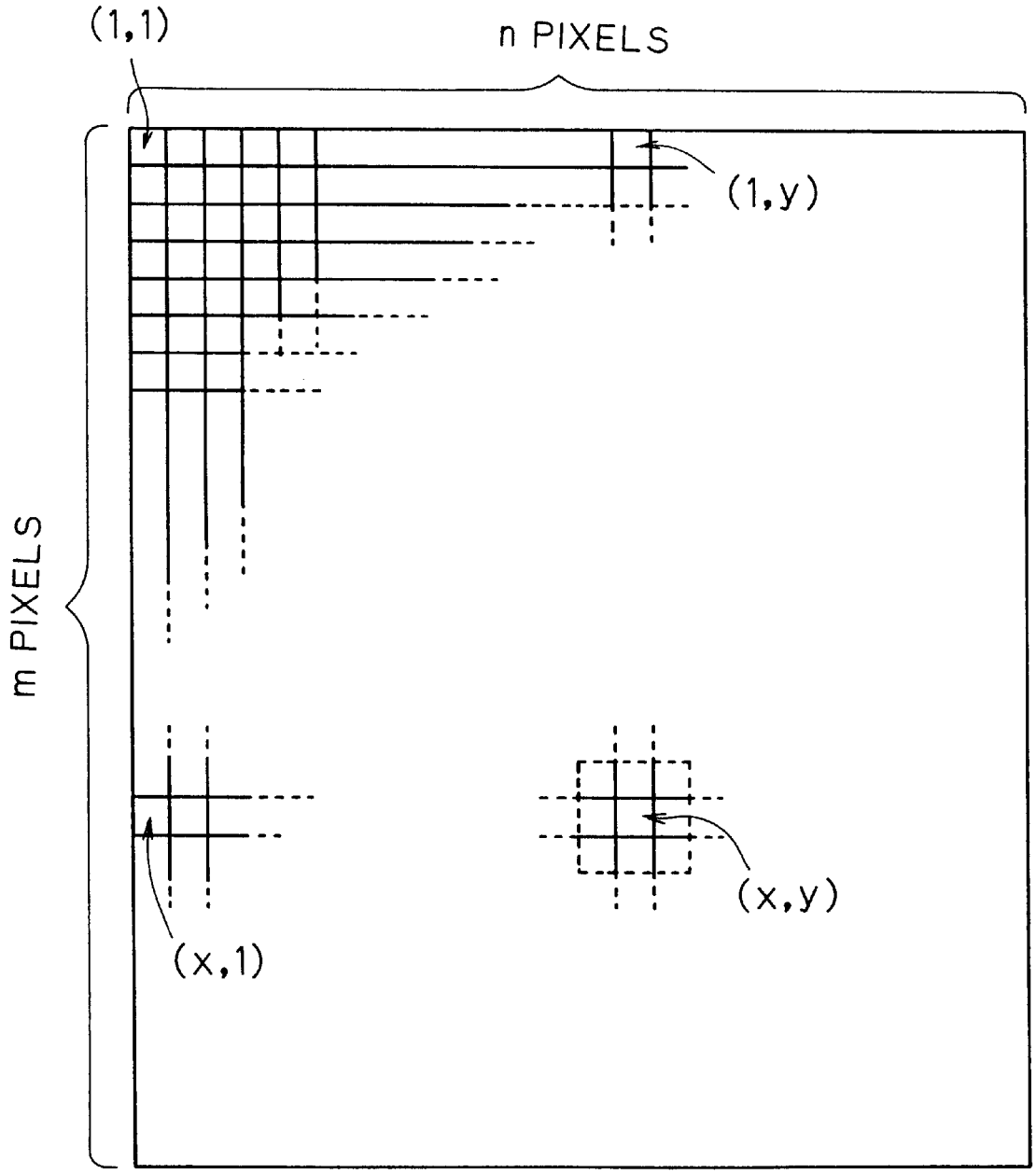
FIG. 7 is a diagram for explaining a definition of resolution.

FIG. 7 is a diagram for explaining the resolutions of the reference image data DST and the print image data DP according to this preferred embodiment. In this preferred embodiment, both the reference image data, DST and the print image data DP shall have an m- by n-pixel resolution which is equivalent to a state where the longitudinal and horizontal dimensions of the reference image PST are divided respectively into m equal parts and n equal parts (where m and n are integers of at least 2). Further, a pixel in the x-th row and the y-th column from the upper left corner of the image is expressed as (x, y).

2-4. Color Difference Data Calculation

After the reference image data DST and the print image data DP of the same resolution are obtained, a color difference therebetween for each pixel is calculated to produce the color difference data DC which is data relating pixels to color differences (step S9).

FIGS. 8A and 8B are diagrams for explaining the color difference data DC. As shown in FIG. 8A, chromaticity of the pixel (x, y) in the reference image data DST is expressed as ($L1_{xy}$, $a1_{xy}$, $b1_{xy}$) and chromaticity of the pixel (x, y) in the print image data DP as ($L2_{xy}$, $a2_{xy}$, $b2_{xy}$). Where ($\Delta L_{xy}$, $\Delta a_{xy}$, $\Delta b_{xy}$) is the color difference for the pixel (x, y), the following is true:

$$\Delta L_{xy}=L2_{xy}-L1_{xy}$$
$$\Delta a_{xy}=a2_{xy}-a1_{xy} \quad (1)$$
$$\Delta b_{xy}=b2_{xy}-b1_{xy}$$

By performing this calculation for all the pixels, the color difference data DC as shown in FIG. 8B can be obtained.

2-5. Region Segmentation

In parallel with the production of the color difference data DC in step S9, region segmentation is performed to divide the reference image PST virtually into a plurality of regions (step S10). Region segmentation is performed in the region segmentation section 304 based on the color distribution data DCD and the texture distribution data DTD for the reference image PST.

Figure 9A:
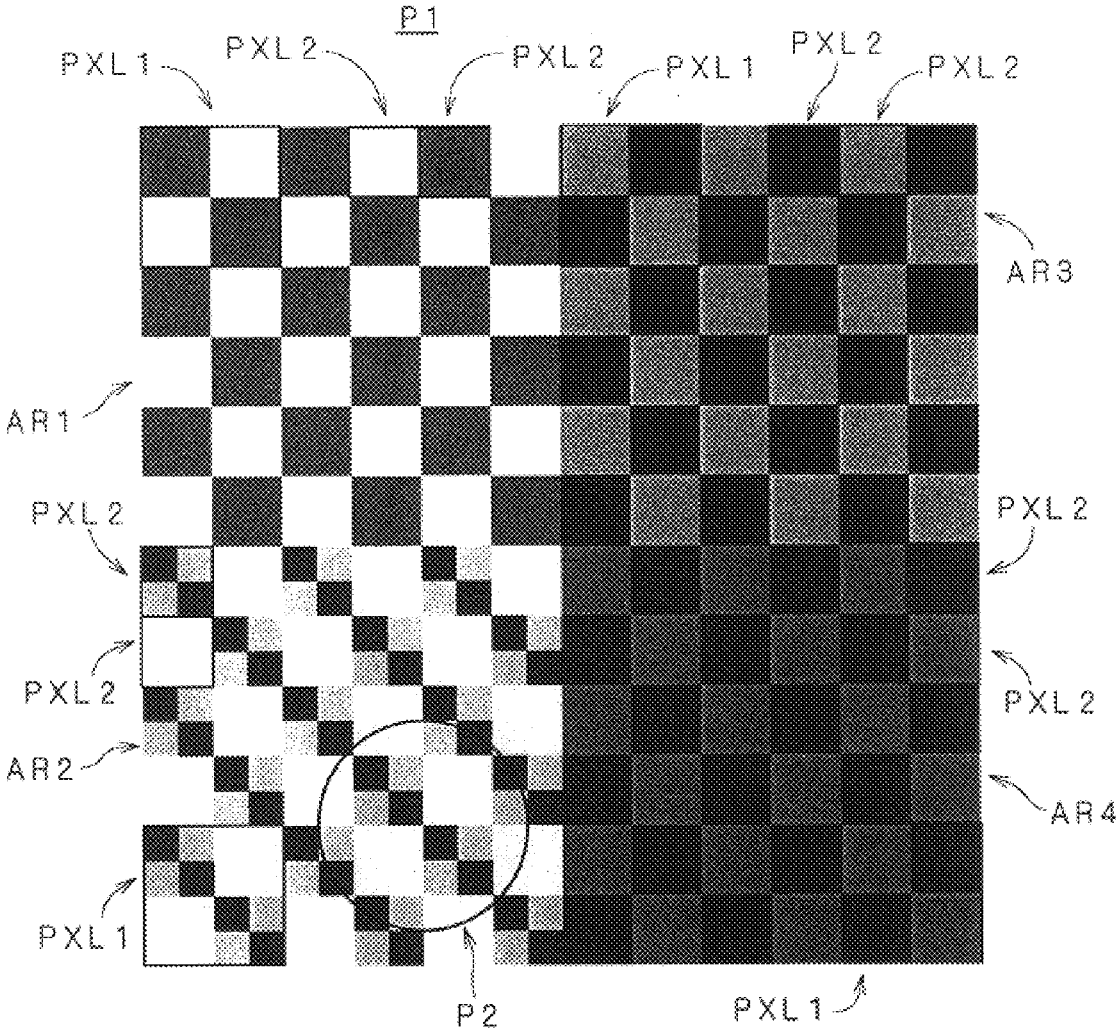
FIGS. 9A and 9B are diagrams for explaining region segmentation.
Figure 9B:
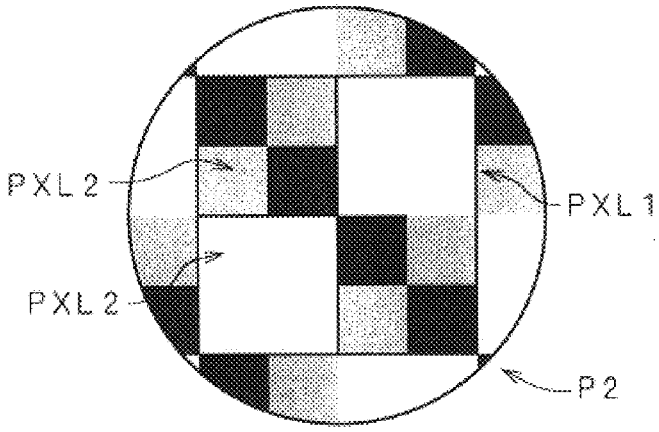

FIGS. 9A to 12 are diagrams for explaining the region segmentation. Now consider a case where an image P1 shown in FIG. 9A is region-segmented. The image P1 consists of four large regions AR1 to AR4 of different color schemes or textures.

Figure 10:
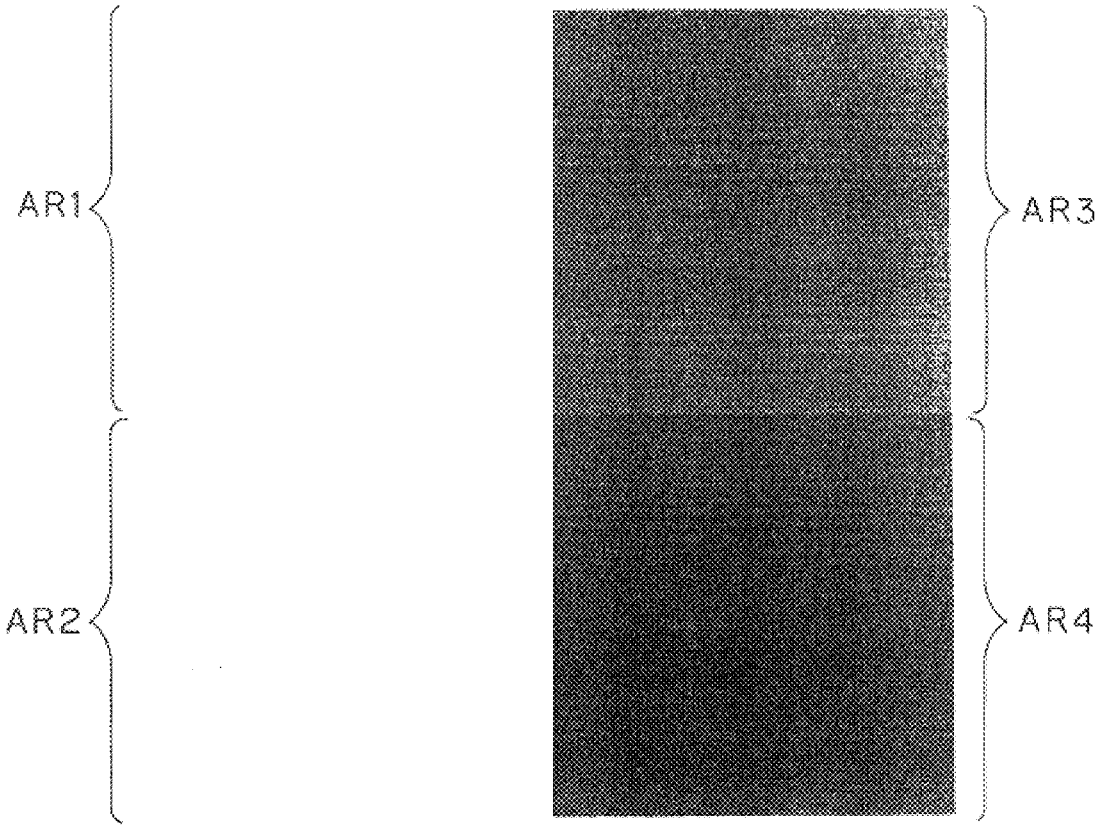
FIG. 10 is a diagram showing an example of the result of average filtering where a reference pixel size is large.
Figure 11:
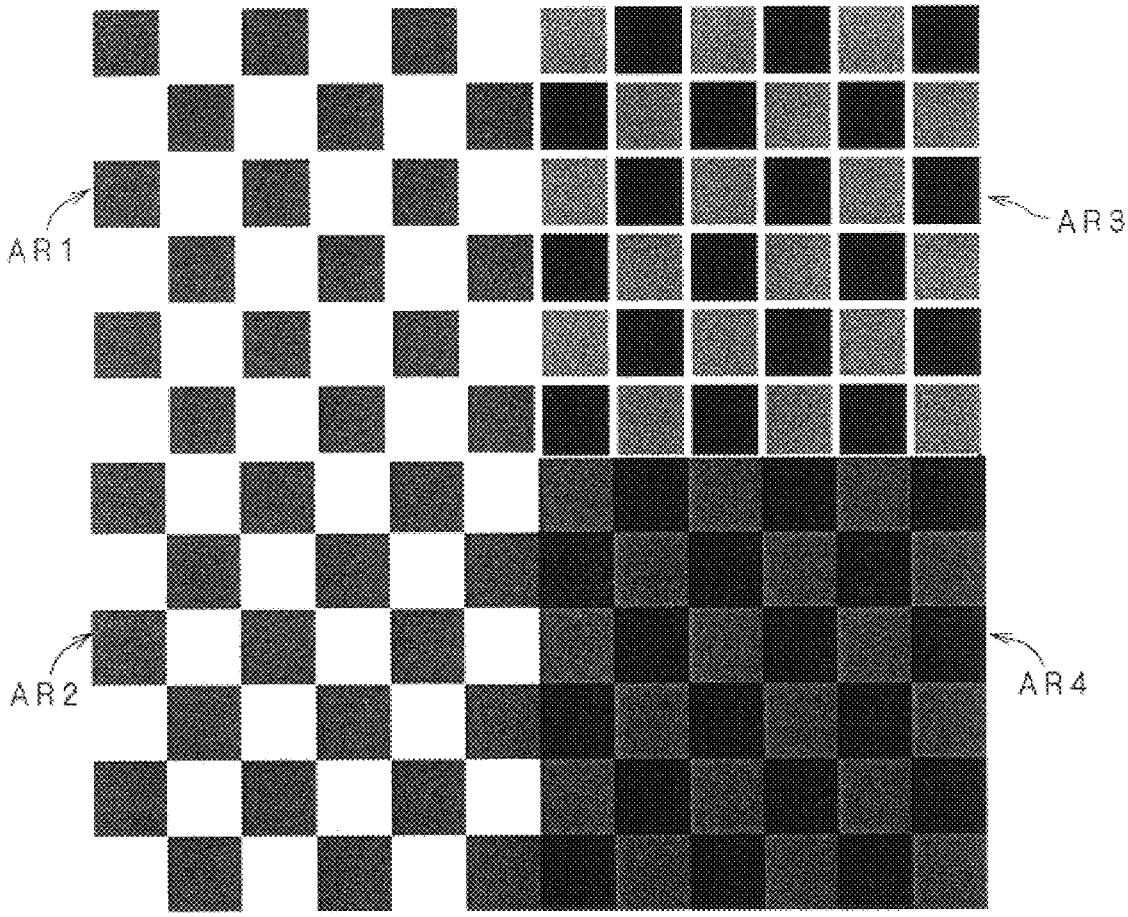
FIG. 11 is a diagram showing an example of the result of average filtering where a reference pixel size is small.

The color distribution data DCD is data obtained by average filtering in the average filtering section 302. Average filtering is the process of averaging the chromaticity of adjacent pixels as previously described. FIG. 10 shows an example of the result of average filtering where a pixel block used as a reference for averaging is defined as PXL1 in FIGS. 9A and 9B. The example of the result of FIG. 10 indicates that, although digital data in the pixel block PXL1 are different in each region and it is perfectly possible to distinguish between a combined region of the regions AR1 and AR2 and that of the regions AR3 and AR4, it is difficult to distinguish between the regions AR1 and AR2 and between the regions AR3 and AR4. Especially for the regions AR1 and AR2, although the details of data in the pixel block PXL1 are different in each of the regions, individual pixels in the pixel block PXL1 have exactly the same chromaticity and thus, the two regions AR1 and AR2 are detected as a single region. Further, this example of the result does not reflect texture since the size of the pixel block PXL1 used as a reference is larger than the pattern of texture which characterizes the image. FIG. 11 shows another example of the result of average filtering where the reference pixel block size is defined as PXL2 in FIGS. 9A and 9B. The example of the result of FIG. 11 indicates that color distributions obtained in the regions AR1, AR3 and AR4 are exactly the same as shown in FIG. 9A, but a color distribution smaller than the pixel block PXL2 in the region AR2 cannot be recognized. In this fashion, average filtering has the characteristic that its reproducibility of color distributions depends on a reference pixel size.

Figure 12:
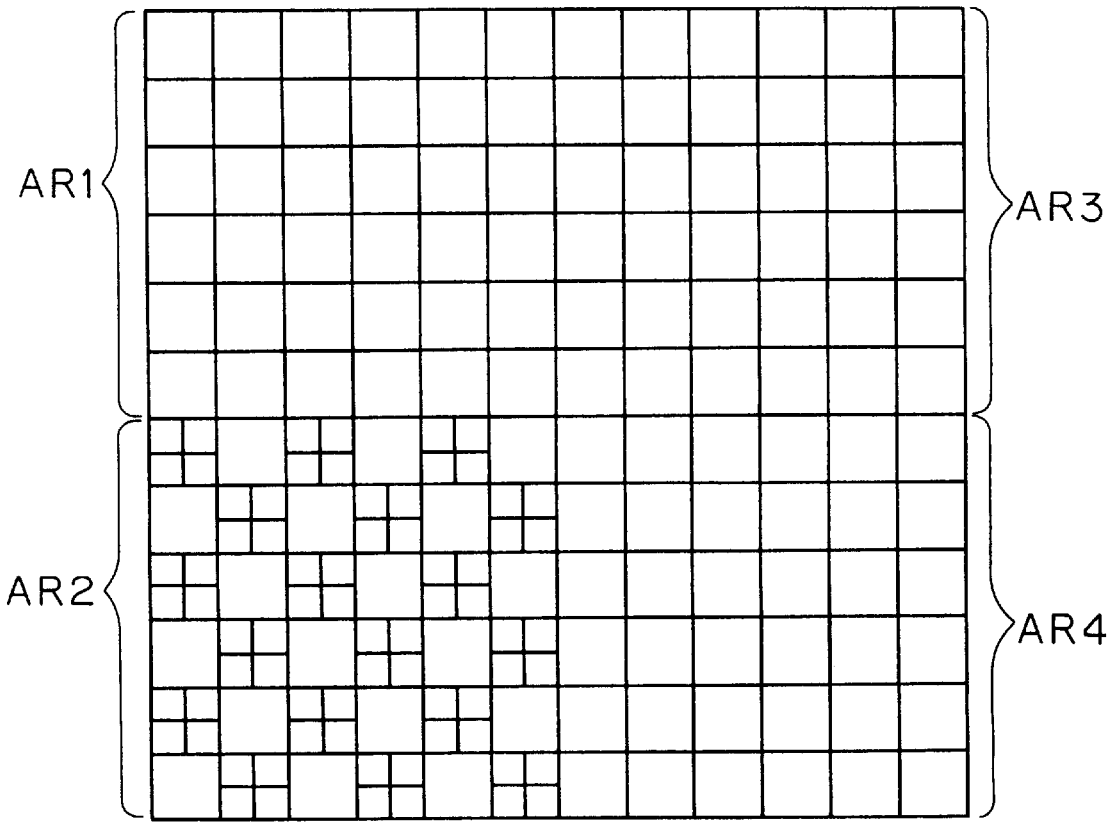
FIG. 12 is a diagram showing the result of high frequency filtering.

On the other hand, high frequency filtering is, as previously described, the process of extracting only a texture component from the reference image PST as a two-dimensional pattern distribution independent of color. FIG. 12 shows an example of the result of high frequency filtering performed on the image of FIG. 9A, showing resultant texture distribution data DTD. In FIG. 12, only recognized texture edges are shown.

The example of the result of FIG. 12 indicates that, although the texture of the region AR2 can be recognized properly, the textures of the regions AR1, AR2 and AR3 which have different color distributions but have almost the same pattern of textures cannot be distinguished from one another. In this fashion, high frequency filtering has the characteristic of receiving no information about color distribution.

After the individual processing steps of average filtering and high frequency filtering, the region segmentation section 304 performs the process of extracting regions AR of different colors and textures from the reference image PST, based on the information about boundaries obtained from the color distribution data DCD obtained by the average filtering process, the texture distribution data DTD obtained by the high frequency filtering process, and the ink supply regions IS. The extracted regions AR each are assigned a region number ID for identification.

Figure 13:
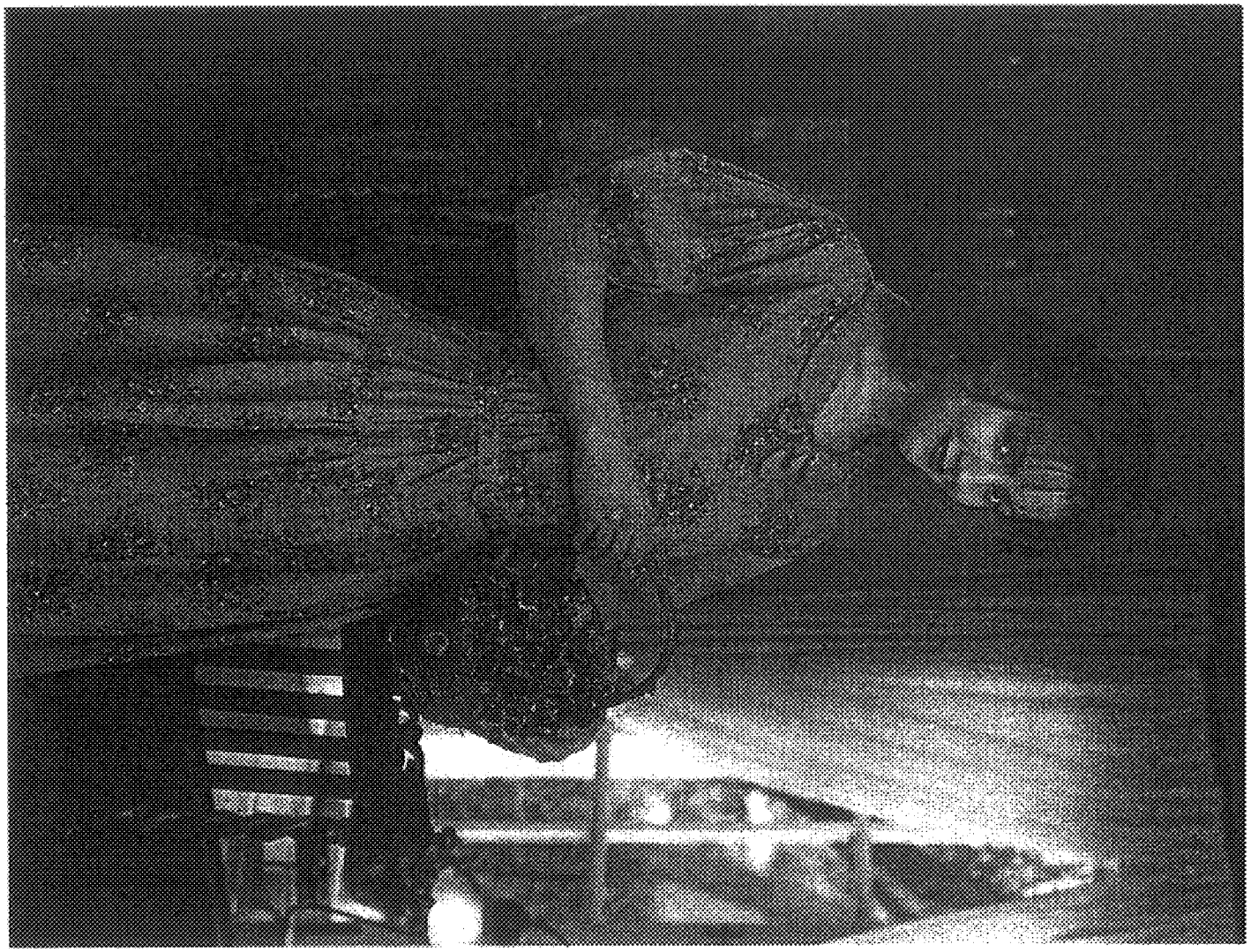
FIG. 13 is a diagram showing an example of a reference image PST.
Figure 14:
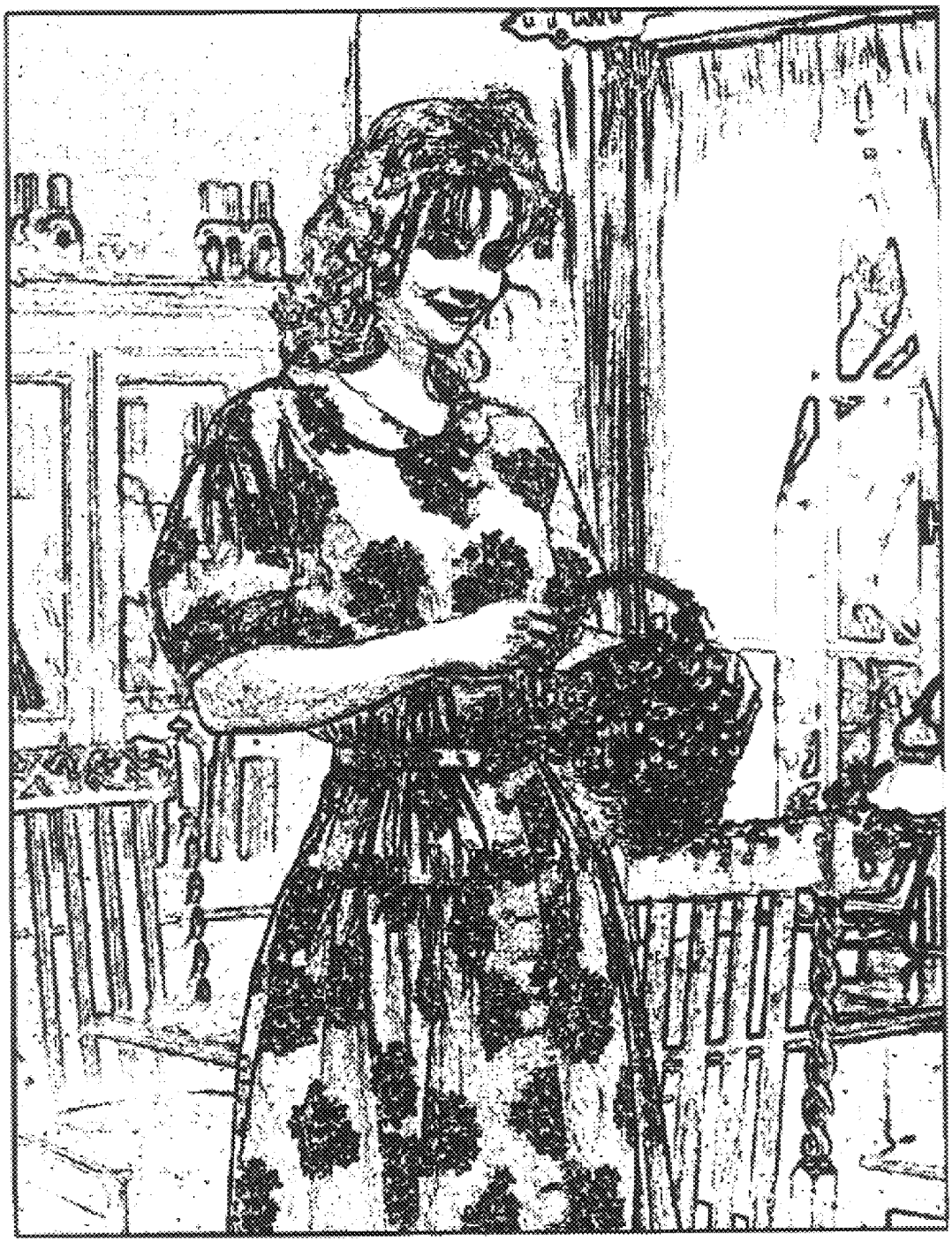
FIG. 14 is a diagram showing the reference image PST with edge extracted.

FIG. 13 shows an example of the reference image PST to be processed in this preferred embodiment. FIG. 13 is originally a color image. FIG. 14 is a supplemental diagram of FIG. 13 for extracting only edges from FIG. 13 to disclose the details. Thus, FIG. 14 is not subjected to essential processing in this preferred embodiment.

Figure 15:
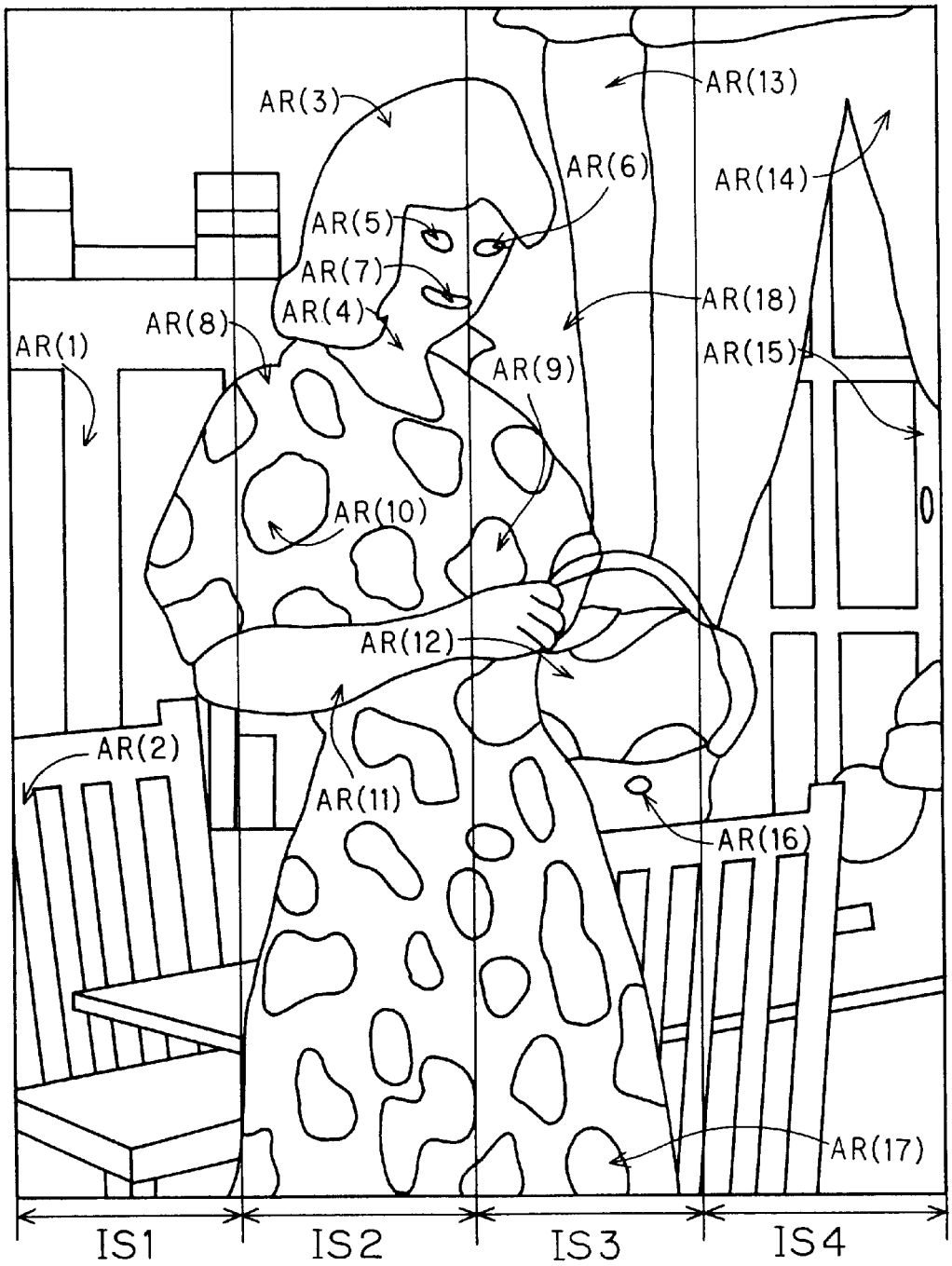
FIG. 15 is a diagram showing an example of region segmentation, PTSD.

FIG. 15 is a schematic diagram showing an example of region segmentation PSTD obtained by performing region segmentation on the reference image PST of FIG. 13 after the acquisition of the color distribution data DCD and the texture distribution data DTD. The reference image PST in FIGS. 13 and 15 are divided into four ink supply regions IS1 to IS4 for printing. In FIG. 15, only major object regions AR are assigned region numbers ID. Hereinafter, the object region AR whose identification number ID is i is referred to as the region AR(i).

The region segmentation section 304 produces the regional data DAR including data representing color characteristics of the region such as chromaticity and texture of the region, and data representing geometrical characteristics of the region such as region size and numerical values indicating the locations of the region and its adjacent regions in the reference image PST. The regional data DAR forms part of the regional parameter table PTB later to be described. FIG. 16 is a diagram showing an example of a data format of the regional parameter table PTB. In this preferred embodiment, the chromaticity is, as previously described, expressed in the L*a*b* calorimetric system, taking the barycenter ($L_i$, $a_i$ $b_i$) of a chromaticity distribution in the region AR(i) and a half value width ($WL_i$, $Wa_i$, $Wb_i$) of the distribution as representative values. Further, the texture is expressed as a spatial self-correlation function T, the region size as the area S of the region, and the location of the region as the location ($x_i$, $y_i$) of a pixel located in the barycenter of the region. The region AR(i) shall have mi adjacent regions expressed as $Ki_1$ to $Ki_{mi}$. The larger the value of the spatial self-correlation function T, the coarser the texture. The spatial self-correlation function T is calculated by using, for example, a technique disclosed in "Methods of Image Pattern Recognition" by M. Nagao, published by CORONA PUBLISHING CO., LTD, 1983. However, the techniques for evaluating the regional data DAR are not limited to those described hereinabove.

2-6. Generation of Regional Parameter Table

After the acquisition of the color difference data DC and the regional data DAR, the parameter table generation section 305 generates the regional parameter table PTB (step S11). The regional parameter table PTB includes the regional data DAR and the regional color difference data DCAR later to be described.

Figure 17:
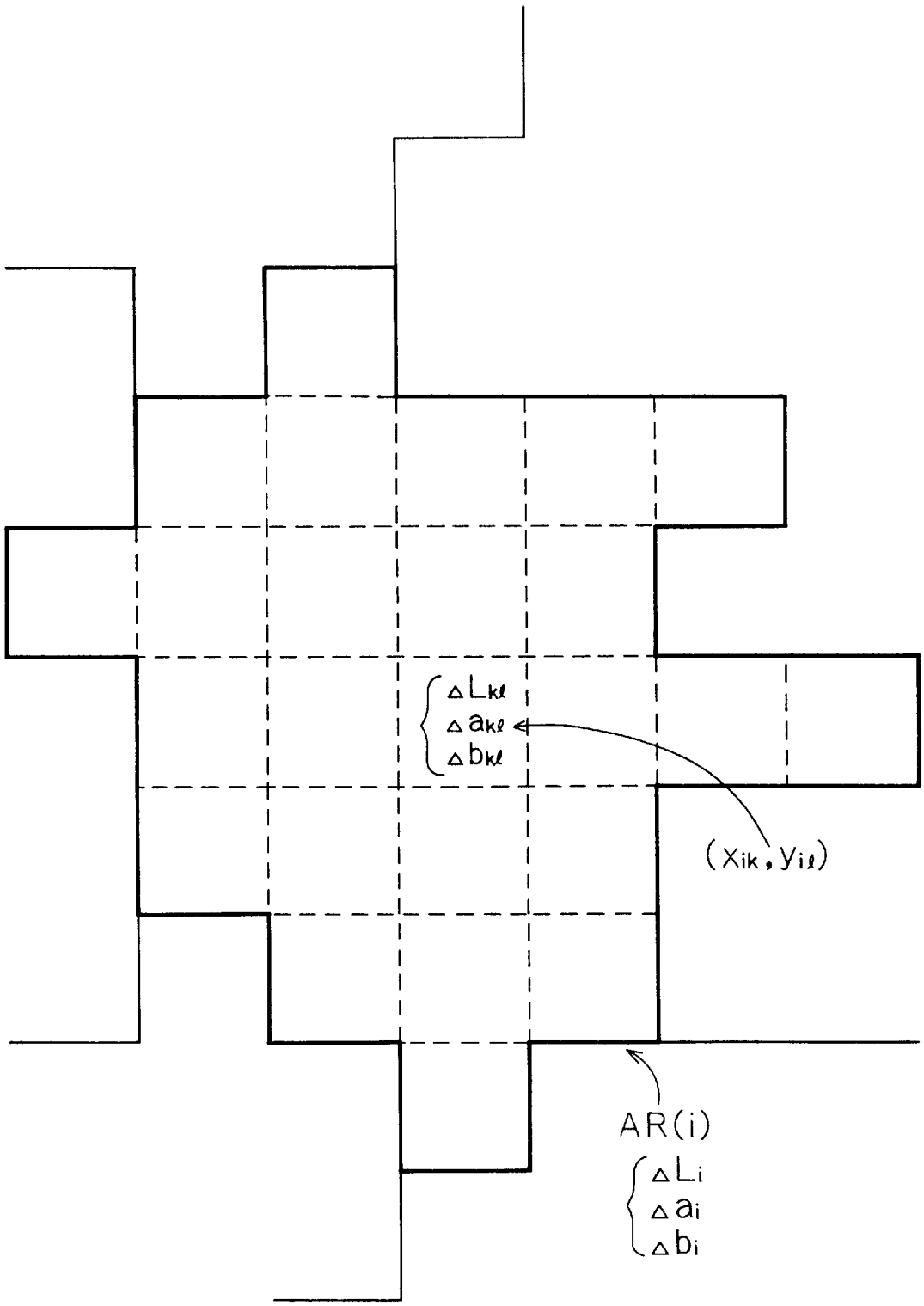
FIG. 17 is a diagram for explaining regional color difference data DCAR.

FIG. 17 is a diagram for explaining the regional color difference data DCAR. The regional color difference data DCAR can be obtained by summing color differences for all the pixels in the region, for each of the regions AR(i) obtained by region segmentation. Where ($\Delta L_{kl}$, $\Delta a_{kl}$, $\Delta b_{kl}$) is the color difference for the pixel ($x_{ik}$, $y_{il}$), the sum total ($\Delta L_i$, $\Delta a_i$, $\Delta b_i$) of the color differences for all the pixels in the region AR(i) can be expressed by:

$$\Delta L_i = \sum_{k,l} \Delta L_{kl} \qquad (2)$$

$$\Delta a_i = \sum_{k,l} \Delta a_{kl}$$

$$\Delta b_i = \sum_{k,l} \Delta b_{kl}$$

where Σ is performed only on the pixels within the region AR(i).

The resultant sum total ($\Delta L_i$, $\Delta a_i$, $\Delta b_i$) is the regional color difference data DCAR and it is equivalent to a color difference between the reference image data DST and the print image data DP in the region AR(i). The regional color difference data DCAR also forms the regional parameter table PTB in FIG. 16.

2-7. Attribute Judgment

The regional data DAR and the regional color difference data DCAR, both forming the regional parameter table PTB, do not contain information as to which part of the reference image PST is constituted by each of the regions AR(i). For example, the regions AR(i) obtained from FIG. 15 are actually regions of a human face, clothes, chairs, curtains and the like.

We usually recognize the chromaticity of various parts of human (such as face, hairs and skin) and the locations of those parts (e.g., hairs near the face, eyes and lips in the face, etc.) based on a certain image or a fixed idea. The same can be said of skies, clouds, sea, forests and the like in landscape photography. Thus, even with a slight difference in chromaticity, we feel a strong sense of incompatibility.

In this preferred embodiment, the regional-attribute judgment section 306 judges whether or not each of the regions AR(i) has a regional attribute AAR corresponding to such specific kinds of subject images as above described. Each regional attribute AAR is given an attribute number NA, and the attribute number NA of the region AR(i) is expressed as Ai. A pair of the region number ID and the regional attribute AAR makes the regional attribute data DAAR (step S13). For a region AR(i) which does not apply to any of previously stored specific regional attributes AAR is given an attribute number NA which indicates that the region does not have a specific attribute. The regional attribute data DAAR is, as shown in FIG. 16, data to be added to the regional parameter table PTB.

Here, a human face, human hairs, human skin, skies, clouds, sea, forests and the like are concrete examples of the regional attributes AAR. The criteria for determining whether or not the region AR(i) have such regional attributes AAR are previously generated as the attribute judgment database DBA. The attribute judgment database DBA is stored in the data storage section 36 and an operator can make additions or changes (edits) thereto with operation of the keyboard 32K and the mouse 32M.

The obtained regional attribute data DAAR is used in the following color difference correction.

2-8. Color Difference Correction

After the regional parameter table PTB is obtained, the I/W supply data DSP is determined based on the table. In the case of the reference image PST shown in FIG. 13, the I/W supply data DSP is set for each of the ink supply regions IS1 to IS4 shown in FIG. 15, according to parameters of the regions AR(i) included in each of the ink supply regions IS1 to IS4 such as chromaticity and size. However, the individual regions AR(i) have various roles in the reference image PST; for example, even if regions are of similar chromaticity and size, required print quality differs between so-called solidly colored regions with little change in texture and high frequency regions with fine patterns. When looking at printed matter, we can easily recognize even a slight difference in chromaticity in the former regions, but we, in most cases, cannot recognize some differences in chromaticity in the latter regions. By setting the I/W supply data DSP in consideration of such characteristics of both the above regions, more precise I/W supply control is made possible. The same is true for the regions AR(i) having specific regional attributes AAR such as human face and hairs, as above described.

In this preferred embodiment, more effective I/W supply control is made possible by, in setting the I/W supply data DSP, correcting the regional color difference data DCAR in accordance with the characteristics and importance of each region AR(i). The correction is performed by multiplying a color difference value by the color difference correction factor f. The color difference correction factor f is a factor which psychophysically quantifies the importance of image characteristics in human visual recognition. Since the regional color difference data DCAR corrected by the color difference correction factor f is equivalent to color differences obtained by actual human visual recognition, it can be taken as a value called an "organoleptic evaluation value".

The color difference correction factor f is given as a function for each element of the regional parameter table PTB according to a predetermined correction rule and is previously stored as the color difference correction factor database DBC in the data storage section 36. An operator can make additions and changes (edits) to the color difference correction factor database DBC with operation of the keyboard 32K and the mouse 32M. Such edits and additions based on manual operations can also be made in the case of using a correction rule based on responsiveness of subjective information with respect to time, which will later be described.

FIGS. 18A to 18G are diagrams showing examples of the major color difference correction factors f. Correction is performed on each of three elements (ΔL, Δa, Δb) of the color difference, but for simplicity, the color difference is shown as one element in FIGS. 18A to 18G. The following are examples of correction rules (a) to (g) for the color difference correction factor f shown respectively in FIGS. 18A to 18G, and symbols used in FIGS. 18A to 18G. In the following, symbols enclosed in brackets are actual factors and parameter values.

(a) "The higher the color uniformity in region, the smaller the color difference value"
Chromaticity Half Width: $W_i(W_{Li}, W_{ai}, W_{bi})$
Half-width Correction Factor: $f_{Wi}(f_{WLi}, f_{Wai}, f_{Wbi})$ (b) "The larger the region size, the larger the color difference value"
Region Size: $S_i$
Size Correction Factor: $f_{Si}(f_{SLi}, f_{Sai}, f_{Sbi})$ (c) "The finer the texture, the smaller the color difference value"
Texture: $T_i$
Texture Correction Factor: $f_{Ti}(f_{TLi}, f_{Tai}, f_{Tbi})$ (d) "Increase the color difference value for region with face attribute"
Regional Attribute: Ai
Face Attribute Number: NAf
Attribute Correction Factor: $f_{Ai}(f_{ALi}, f_{Aai}, f_{Abi})$
Factor for Region with Face Attribute: $f_{A0}(f_{AL0}, f_{Aa0}, f_{Ab0})$ (e) "The closer the region is to the corners of image, the larger the color difference value"
Regional Location: $(x_i, y_i)$
Upper Corner of Image: $x_l$
Lower Corner of Image: $x_m$
Left Corner of Image: $y_l$
Right Corner of Image: $y_n$
Location Correction Factor: $f_{xyi}(f_{xyLi}, f_{xyai}, f_{xybi})$ (f) "The closer the region is to the boundary of ink supply region, the smaller the color difference value"
y Component of Regional Location: $y_i$
Boundary of Ink Supply Region: $(y_{bii+1})$
Boundary Correction Factor: $f_{bi}(f_{bLi}, f_{bai}, f_{bbi})$ (g) "The higher the density of Y (yellow) component of the region adjacent to gray region in the same ink supply region, the larger the color difference value of only Y component of the gray region"
Adjacent Region Number: $Ki_{mi}$
b Component of Chromaticity of Adjacent Region: $b_{Ki}$
Gray Region Correction Factor: $f_{gbi}$ FIG. 19 is a diagram qualitatively showing the color difference correction factor f for each region where the aforementioned examples of correction rules are applied to the example of region segmentation PSTD shown in FIG. 15. While only typical regions for the respective correction rules are shown in FIG. 19, it is to be understood that, in practice, all the color difference correction factors f are given as numerical values for every region AR(i).

Where $(\Delta L_{ri}, \Delta a_{ri}, \Delta b_{ri})$ is the color difference of the region AR(i) after execution of correction based on the color difference correction factors shown in FIG. 18, the following are true:

$$\begin{aligned} \Delta L_{ri} &= \Pi f_{Li} \Delta L_i \\ \Delta a_{ri} &= \Pi f_{ai} \Delta a_i \\ \Delta b_{ri} &= \Pi f_{bi} \Delta b_i \end{aligned} \tag{3}$$

where Π is the product of all the correction factors.

By correcting the color differences as above described, the setting of the I/W supply data DSP can reflect the contents of the reference image PST.

It should be noted herein that the correction rules are not limited to those described above, and so are the color difference correction factors f. The color difference correction factors f can be set as appropriate according to the correction rules to be employed.

2-9. Correction Based on Subjective Information

Based on the corrected color difference $(\Delta L_{ri}, \Delta a_{ri}, \Delta b_{ri})$, the I/W supply setting section 307 once sets the I/W supply data DSP as the virtual I/W supply data DSPT. Prior to this, correction based on the subjective information is performed. This will be described hereinbelow.

The quality of printed matter depends also on service conditions of the printing machine 2 such as the years of use and the wear rate of drive components and on surrounding environments of the printing machines 2 (e.g., weather, temperature, humidity, the volume of air, etc.). In the conventional operations by the "chief operator", according to the "chief operator's" know-how based on his/her experience and personal point of view, I/W supply control has been performed in consideration of external variable factors that are difficult to control with the printing machine 2 itself.

In this preferred embodiment, data necessary for adjustment for such external variable factors is held as the subjective information factor database DBS in the data storage section 36 and applied in setting the I/W supply data DSP. Thus, more efficient I/W supply control can be achieved.

FIG. 20 is a diagram showing an example of the subjective information factor database DBS. In FIG. 20, the subjective information factor database DBS consists of n evaluation items relating to the I supply and m evaluation items relating to the W supply. Depending on whether each item is to apply or not, the set values of the virtual I/W supply data DSPT are corrected. The correction is performed where each of the items is to apply, by multiplying the virtual I/W supply data DSPT by a subjective information factor s determined for each of the evaluation items. Where the item is not to apply, the subjective information factor s is set to 1. The equation for setting the supply will be described later.

2-10. Control Based on Fluctuation in I/W Supply With Time

By the correction based on the subjective information, the virtual I/W supply data DSPT is obtained in the I/W supply setting section 307 (step S15). The set values of the virtual I/W supply data DSPT may be applied to the printing machine 2 as the I/W supply, but the fact is that delays can occur until the I/W supply reaches the set values. This introduces an overshoot of fluctuations in the I/W supply and thus can be obstructive to rapid and proper supply control. In this preferred embodiment, therefore, the setting of the I/W supply data DSP is performed considering fluctuations in the I/W supply with respect to time as responsiveness with respect to time (steps S16, S17, S18). Such predictive control can avoid time delay.

Figure 21:
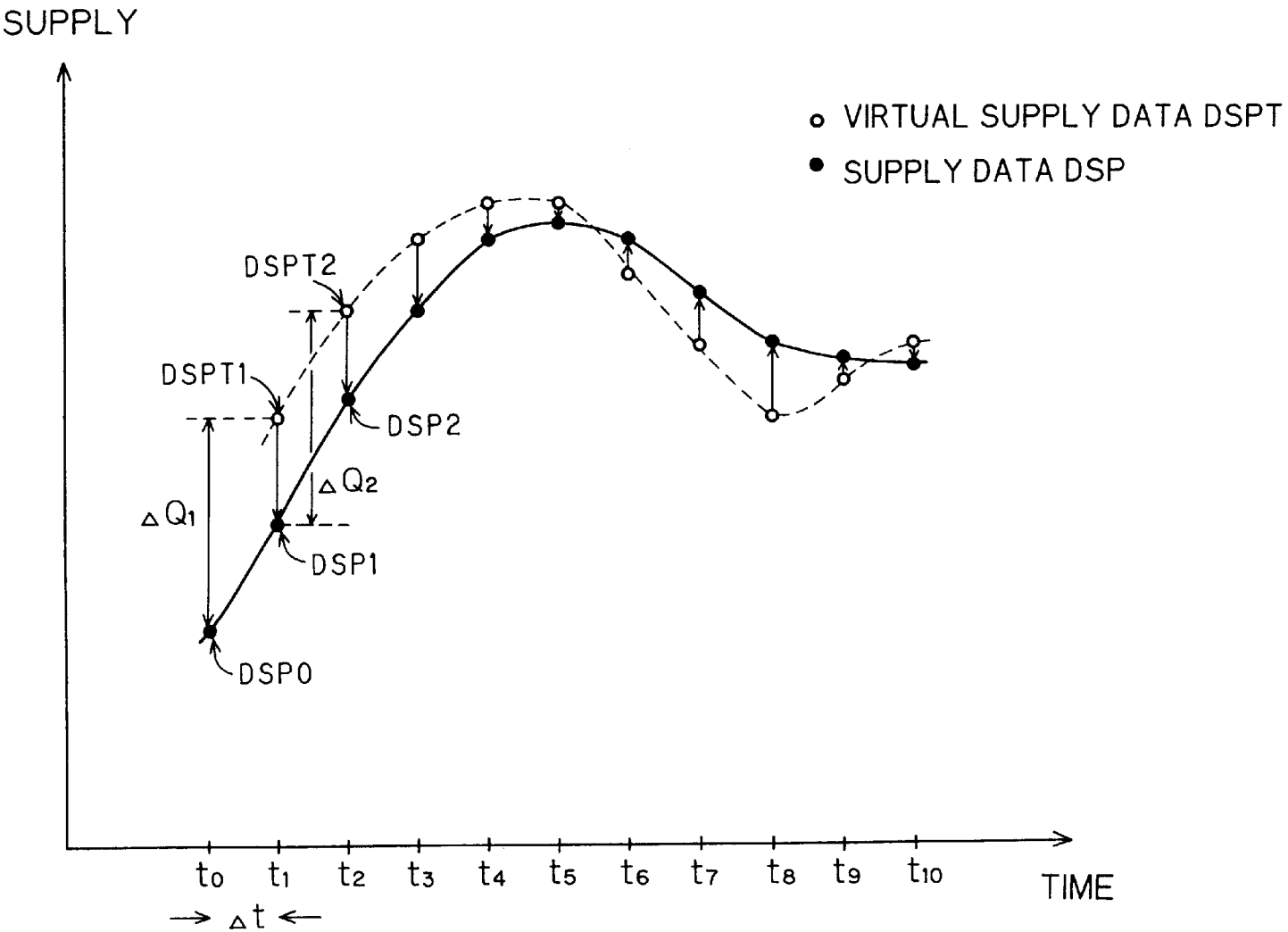
FIG. 21 is a diagram for explaining a case where the I/W supply is set in consideration of changes of supply with time.
Figure 22:
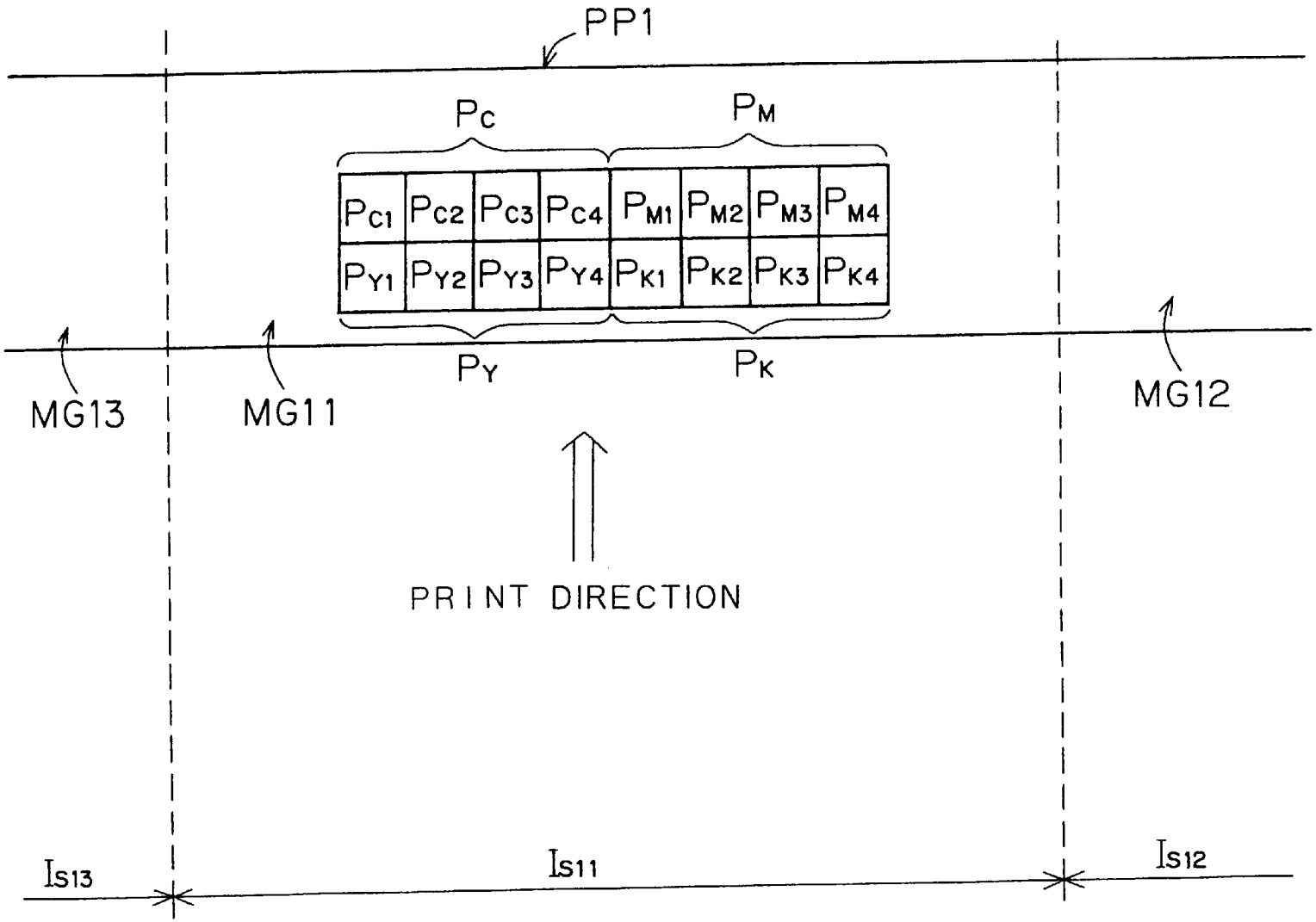
FIG. 22 is a diagram for explaining a color patch measurement method.
Figure 23B:
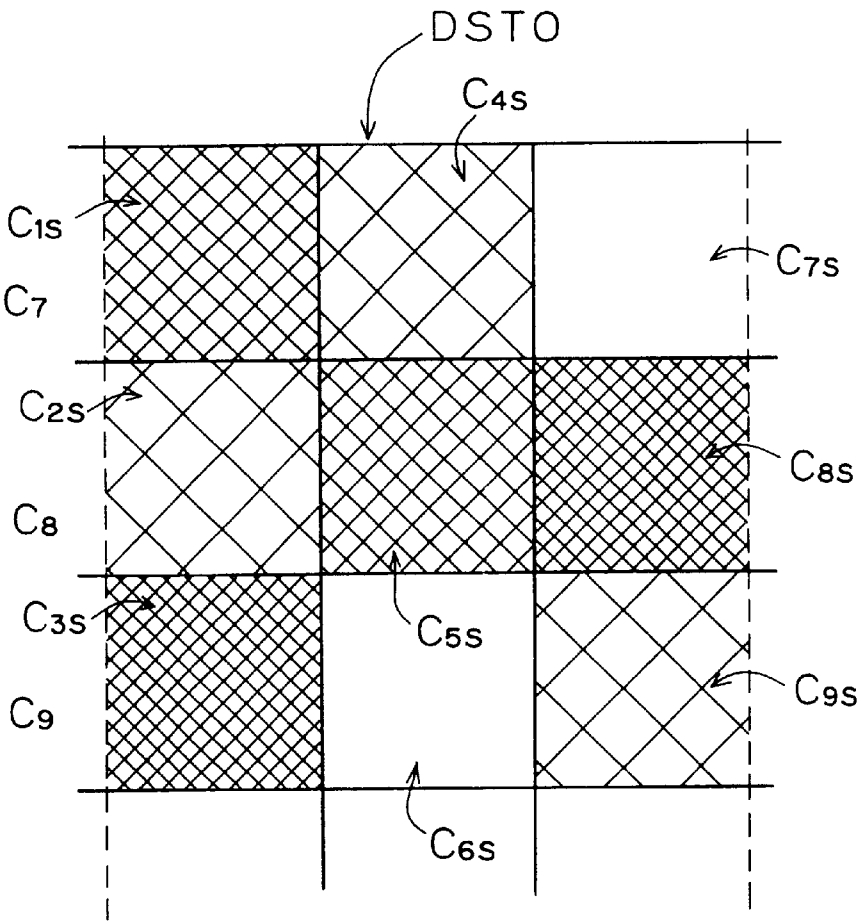
FIGS. 23A and 23B are diagrams for explaining an image comparison method.
Figure 23A:
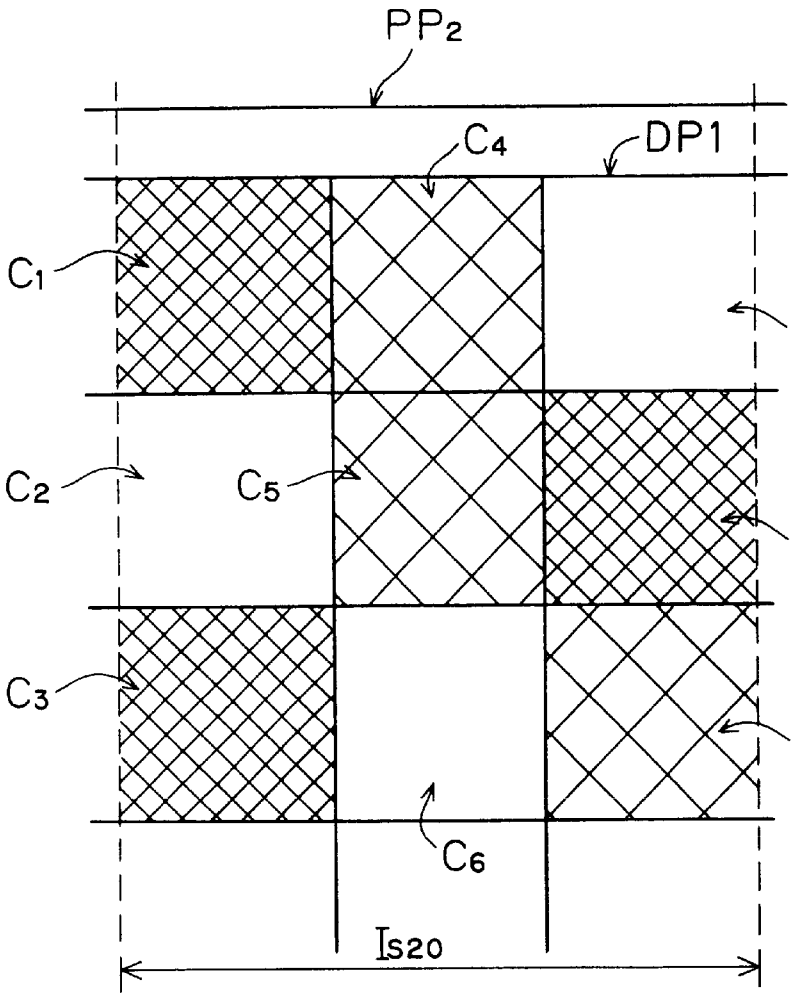

FIG. 21 is a diagram schematically showing fluctuations in I/W supply Q, which is applicable to both the I and W supplies. In FIG. 21, the I/W supply Q is set at predetermined time intervals $\Delta t$, for example at times $t_0, t_1, \ldots t_{10}$. The I/W supply data and the virtual I/W supply data at the time $t_i$ are expressed respectively as $DSP_i$ and $DSPT_i$.

When the virtual I/W supply data $DSPT_i$ is set at the time $t_i$, then a difference $\Delta Q_i$ between the data $DSPT_i$ and previously stored I/W supply data $DSP_{i-1}$ set at the next previous time $t_{i-1}$ is calculated. By multiplying the virtual I/W supply data $DSPT_i$ at the time $t_i$ by a fluctuation adjustment factor $\tau$ which is predetermined as a function of the difference $\Delta Q_i$, the I/W supply data $DSP_i$ is determined. The fluctuation adjustment factor $\tau$ is a factor which takes a value smaller than 1 when the difference $\Delta Q_i$ is positive and takes a value larger than 1 when the difference $\Delta Q_i$ is negative.

In FIG. 21, changes in the I/W supply data DSP obtained by correcting the virtual I/W supply data DSPT are indicated by the solid line. On the other hand, changes in the virtual I/W supply data DSPT are indicated by the broken line. When a predetermine time delay is given to the respective curves, i.e., when the respective curves are shifted in a positive horizontal direction, both the curves themselves represent fluctuations in the actual I/W supply Q where correction is made and where no correction is made. As is evident from both the curves, the curve with correction, i.e., the curve for the I/W supply data DSP shows a smaller fluctuation.

2-11. I/W Supply Setting

In accordance with the contents so far described, the I/W supply data DSP is eventually determined. The I/W supply data DSP is data including an I supply $Q_I$ and a W supply $Q_W$ for each of the ink supply regions IS in each of the I/W supply sections 22K, 22C, 22M and 22Y. The I/W supply data DSP for one ink supply region IS can be expressed by:

$$Q_I=\tau_I \Pi S_{Ii} F(\Sigma\Delta L_{ri}, \Sigma\Delta a_{ri}, \Sigma\Delta b_{ri})$$

$$Q_W=\tau_W \Pi S_{Wi} G(\Sigma\Delta L_{ri}, \Sigma\Delta a_{ri}, \Sigma\Delta b_{ri}) \quad (4)$$

where $F(\Sigma\Delta L_{ri}, \Sigma\Delta a_{ri}, \Sigma b_{ri})$ and $G(\Sigma\Delta L_{ri}, \Sigma\Delta a_{ri}, \Sigma b_{ri})$ are the I/W supply determination functions when not considering the subjective information and the fluctuations in the I/W supply with respect to time, respectively. $\Sigma$ is performed only on regions included in each of the ink supply regions. $S_{Ii}$ is the subjective information factor with respect to ink, $S_{Wi}$ is the subjective information factor with respect to water, and $\Pi$ is the product of all the factors $S_{Ii}$ or $S_{Wi}$.

The determined I/W supply data DSP is fed back as part of the print control data DPC to the printing machine 2 in which printing is performed based on the newly set I/W supply (step S3). Printing is completed if a required number of sheets of good-quality printed matter are obtained (step S4), and if further I/W supply control is necessary, the steps after step S7 are repeated.

As above described, by the use of the I/W supply control method of this preferred embodiment for printing operations, even unskilled operators can perform rapid I/W supply control based on the contents of an image. This prevents blurring and skipping, thereby resulting in a reduction in the number of "waste sheets".

3. Modifications

So far, the preferred embodiment of the present invention has been described, but it is to be understood that the present invention is not limited to the aforementioned preferred embodiment.

In the printing system 1, the printing machine 2 and the image analysis processor 3 need not be provided separately; in fact, they may be of a single-piece construction.

The printing machine 2 is not limited to a single-fed printing machine as described in the above preferred embodiment. It may be a rotary printing machine for printing continuous rolls of paper or may be a double-sided printing machine.

The ink colors for use in printing by the printing machine 2 are not limited to the four colors CMYK shown in the above preferred embodiment. The printing machine 2 may be configured to be capable of performing multicolor printing such as so-called special-feature color (e.g., gold, silver, etc.) printing. The color difference correction factor and the I/W supply determination function are determined according to the colorimetric system to be employed.

The reading of a print image in the image input section 4 may be performed by using a digital camera, instead of using a scanner.

In region segmentation, if segmentation can be performed properly only with either one of the color distribution data DCD and the texture distribution data DTD, region segmentation may be performed by using only either one of those data. For example, in the case of a single-color (monochrome) image, segmentation can be performed only with the texture distribution data.

The colorimetric system representing chromaticity is not limited to the L*a*b* colorimetric system. For example, the RGB or CMYK colorimetric system may be used. The equation for expressing the color difference is defined as appropriate according to the colorimetric system to be employed.

Color difference correction does not necessarily have to be performed. In that case, in Equation (3), the regional color difference data DCAR is not multiplied by the various color difference correction factors.

In setting the fluctuation adjustment factor, not only the next previous I/W supply but also the other previous I/W supply may be taken into consideration.

The setting of the I/W supply may be performed by referring to a predetermined conversion table, instead of using Equation (4).

While the invention has been shown and described in detail, the foregoing description is in all aspects illustrative and not restrictive. It is therefore understood that numerous modifications and variations can be devised without departing from the scope of the invention.

What is claimed is:

1. A controller for controlling respective amounts of ink and water supplied to a printing machine, comprising:

(a) an object region setting element for setting a plurality of object regions in a reference image to be printed, said object regions being set based on reference image data representing said reference image;

(b) a read element for reading an image of printed matter corresponding to said reference image to obtain print image data;

(c) a comparison element for comparing said reference image data and said print image data for each of said object regions to obtain an image comparison result; and (d) a control variable calculation element for calculating control variables for ink and water in said printing machine, said control variables being calculated based on both a regional characteristic and said image comparison result obtained for each of said object regions.

2. The controller according to claim 1, wherein said regional characteristic includes an element corresponding to a visual image characteristic of each of said object regions.

3. The controller according to claim 2, wherein said visual image characteristic includes at least one of:

(1) a color characteristic of each of said object regions;

(2) a texture characteristic of each of said object regions; and (3) a regional attribute depending on the type of a print image included in each of said object regions.

4. The controller according to claim 3, wherein a criterion of said regional attribute can be edited, and a new criterion can be added to said criterion of said regional attribute.

5. The controller according to claim 2, wherein said regional characteristic includes an element corresponding to a geometrical characteristic of each of said object regions in said reference image.

6. The controller according to claim 5, wherein said geometrical characteristic includes at least one of:

(1) a region size of each of said object regions;

(2) a location of each of said object regions in said reference image;

(3) relative positions of each of said object regions and an ink key region of said printing machine; and (4) relative positions of each of said object regions and its adjacent regions.

7. The controller according to claim 1, wherein said object region setting element includes a region segmentation element for segmenting said reference image into a plurality of segment regions, said region segmentation element segmenting said reference image based on similarity in image characteristic, said plurality of segment regions being equivalent to said plurality of object regions.

8. The controller according to claim 1, wherein said comparison element includes an element for obtaining a color difference between said reference image data and said print image data as said comparison result for each of said object regions.

9. The controller according to claim 8, wherein said control variable calculation element includes:

(d-1) a correction element for correcting said color difference for each of said object regions according to a correction rule to obtain a basic control variable; and (d-2) an element for calculating said control variable based on said basic control variable.

10. The controller according to claim 9, wherein said correction rule includes an element corresponding to a visual image characteristic of each of said object regions as an element corresponding to said regional characteristic.

11. The controller according to claim 9, wherein said correction rule further includes an element corresponding to responsiveness of said printing machine to ink and water control.

12. The controller according to claim 9, wherein said correction rule further includes an element obtained empirically according to an external environment.

13. The controller according to claim 9, wherein said correction rule can be edited, and a new criterion can be added to a criterion of said regional attribute.

14. A printing system comprising:

a printing machine; and a controller for controlling respective amounts of ink and water supplied to said printing machine, said apparatus comprising:

(a) an object region setting element for setting a plurality of object regions in a reference image to be printed, said object regions being set based on reference image data representing said reference image;

(b) a read element for reading an image of printed matter corresponding to said reference image to obtain print image data;

(c) a comparison element for comparing said reference image data and said print image data for each of said object regions to obtain an image comparison result; and (d) a control variable calculation element for calculating control variables for ink and water in said printing machine, said control variables being calculated based on both a regional characteristic and said image comparison result obtained for each of said object regions.

15. A program executed by a computer, for having said computer function as information processing equipment, said information processing equipment performs information processing in a controller for controlling respective amounts of ink and water supplied to a printing machine, said controller comprising:

(a) an object region setting element for setting a plurality of object regions in a reference image to be printed, said object regions being set based on reference image data representing said reference image;

(b) a read element for reading an image of printed matter corresponding to said reference image to obtain print image data;

(c) a comparison element for comparing said reference image data and said print image data for each of said object regions to obtain an image comparison result; and (d) a control variable calculation element for calculating control variables for ink and water in said printing machine, said control variables being calculated based on both a regional characteristic and said image comparison result obtained for each of said object regions.

* * * * *